US011341902B2

(12) United States Patent
Lee et al.

(10) Patent No.: US 11,341,902 B2
(45) Date of Patent: May 24, 2022

(54) DISPLAY DEVICE AND METHOD OF DRIVING THE SAME

(71) Applicant: Samsung Display Co., Ltd., Yongin-si (KR)

(72) Inventors: Jae Sic Lee, Yongin-si (KR); Won Kyu Kwak, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/985,185

(22) Filed: Aug. 4, 2020

(65) Prior Publication Data

US 2021/0183302 A1 Jun. 17, 2021

(30) Foreign Application Priority Data

Dec. 16, 2019 (KR) ..... 10-2019-0168209

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2230/00* (2013.01); *G09G 2310/06* (2013.01); *G09G 2320/04* (2013.01)

(58) Field of Classification Search
CPC ..... G09G 2230/00; G09G 2310/0254; G09G 2310/0264; G09G 2310/027; G09G 2310/08; G09G 2320/0223; G09G 2320/0252; G09G 3/3275; G09G 3/3614; G09G 3/3685; G09G 3/32; G09G 3/3233; G09G 2310/06; G09G 2320/04; G09G 2300/0819; G09G 2300/0861; G09G 2310/0262; G09G 3/3266; G09G 3/20; G09G 3/007
See application file for complete search history.

(56) References Cited

U.S. PATENT DOCUMENTS 7,180,486 B2 * 2/2007 Jeong ..... G09G 3/3233 345/82
7,471,267 B2 12/2008 Shin et al.
7,692,619 B2 * 4/2010 Shin ..... G09G 3/3266 345/100

(Continued)

FOREIGN PATENT DOCUMENTS

JP 4490650 6/2010
KR 10-0515351 9/2005

(Continued)

*Primary Examiner* — Michael J Jansen, II
(74) *Attorney, Agent, or Firm* — H.C. Park & Associates, PLC

(57) ABSTRACT

A display device including a display panel including scan lines, emission control lines, and pixels connected to the scan lines and the emission control lines; a first emission driver sequentially providing first emission control signals to odd-numbered emission control lines among the emission control lines in a first frame section; a second emission driver sequentially providing second emission control signals to even-numbered emission control lines among the emission control lines in a second frame section that is continuous from the first frame section; and a scan driver sequentially providing scan signals to the scan lines in each of the first and second frame sections.

18 Claims, 12 Drawing Sheets

(56) References Cited

U.S. PATENT DOCUMENTS 7,742,019 B2 6/2010 Takahara
7,796,107 B2 * 9/2010 Kim ..... G09G 3/3233 345/92
7,808,471 B2 * 10/2010 Shin ..... G09G 3/3266 345/100
7,847,765 B2 * 12/2010 Park ..... G09G 3/3266 345/82
7,936,331 B2 * 5/2011 Uh ..... G11C 19/184 345/100
7,969,402 B2 * 6/2011 Lee ..... G09G 3/3677 345/100
8,022,920 B2 * 9/2011 Kim ..... G11C 19/00 345/100
8,077,168 B2 12/2011 Shin
8,159,446 B2 * 4/2012 Lee ..... G11C 19/184 345/100
8,237,637 B2 8/2012 Chung
8,330,685 B2 * 12/2012 Park ..... G09G 3/3233 345/82
8,373,638 B2 * 2/2013 Jang ..... G09G 3/3677 345/100
8,803,784 B2 * 8/2014 Sakamoto ..... G09G 3/3677 345/100
8,823,628 B2 * 9/2014 Chung ..... G09G 3/20 345/100
9,147,496 B2 * 9/2015 Abe ..... G09G 3/3674
9,368,562 B2 6/2016 Xu
9,501,970 B2 * 11/2016 Park ..... G09G 3/3266
9,886,905 B2 * 2/2018 Toyotaka ..... G09G 3/20
9,922,591 B2 * 3/2018 Ko ..... G06F 3/04184
10,388,228 B2 * 8/2019 Kim ..... G09G 3/3266
10,861,386 B2 * 12/2020 Park ..... G09G 3/3233
10,902,787 B2 * 1/2021 Peng ..... G09G 3/3266
11,004,376 B2 * 5/2021 Choi ..... G09G 3/3266
11,030,943 B2 * 6/2021 Kang ..... G09G 3/3233
2006/0055336 A1 * 3/2006 Jeong ..... G09G 3/3233 315/169.3
2006/0145964 A1 * 7/2006 Park ..... G09G 3/3233 345/76
2006/0156118 A1 * 7/2006 Shin ..... G09G 3/20 714/726
2006/0279511 A1 * 12/2006 Uh ..... G11C 19/28 345/100
2007/0089000 A1 * 4/2007 Shin ..... G09G 3/3266 714/726
2008/0036371 A1 * 2/2008 Kim ..... G09G 3/3233 313/504
2008/0266477 A1 * 10/2008 Lee ..... G11C 19/184 349/46
2010/0283776 A1 * 11/2010 Park ..... G09G 3/3233 345/211
2011/0169874 A1 * 7/2011 Jang ..... G09G 3/3677 345/690
2011/0273421 A1 * 11/2011 Chung ..... G09G 3/20 345/211
2012/0105396 A1 * 5/2012 Sakamoto ..... G11C 19/28 345/204
2012/0306844 A1 * 12/2012 Abe ..... G09G 3/3677 345/212
2013/0069854 A1 * 3/2013 Park ..... G09G 3/3233 345/82
2016/0335953 A1 * 11/2016 Toyotaka ..... G09G 3/3233
2017/0154567 A1 * 6/2017 Ko ..... G11C 19/28
2017/0337877 A1 * 11/2017 Kim ..... G09G 3/3225
2020/0175913 A1 * 6/2020 Kang ..... G09G 3/3266
2020/0202761 A1 * 6/2020 Choi ..... G09G 3/20
2020/0394969 A1 * 12/2020 Kim ..... G09G 3/3266
2020/0410935 A1 * 12/2020 Kim ..... G09G 3/3266

FOREIGN PATENT DOCUMENTS

KR 10-0601379 7/2006
KR 10-0833753 5/2008

* cited by examiner

DISPLAY DEVICE AND METHOD OF DRIVING THE SAME

CROSS-REFERENCE TO RELATED APPLICATION

This application claims priority from, and the benefit of, Korean Patent Application No. 10-2019-0168209, filed Dec. 16, 2019, which is hereby incorporated by reference for all purposes as if fully set forth herein.

BACKGROUND

Field

Exemplary embodiments of the present invention relate generally to a display device and, more specifically, to a method of driving the same.

Discussion of the Background

A display device includes a display panel and a driving unit. The display panel includes scan lines, data lines, and pixels. The driving unit includes a scan driver that sequentially provides scan signals to the scan lines, and a data driver that provides data signals to the data lines. Each of the pixels emits light at a luminance level corresponding to a data signal provided through a corresponding data line in response to a scan signal provided through a corresponding scan line.

The display panel may further include emission control lines, and the driving unit may further include an emission driver that sequentially provides emission control signals to the emission control lines. Emission periods of the pixels may be controlled in response to the emission control signals.

High-speed frame driving may be required to drive a display device including a large-size display panel. However, according to such a high-speed frame driving method, since a length of a section (or scan-on-time: SOT) to which a scan signal is supplied is not sufficiently secured, image quality of the display device may be degraded.

The above information disclosed in this Background section is only for understanding of the background of the inventive concepts, and, therefore, it may contain information that does not constitute prior art.

SUMMARY

Exemplary embodiments of the present invention provide a display device in which a length of a section in which a scan signal is supplied and/or a section in which a data signal is written can be sufficiently secured even when the display device is driven according to a high-speed driving method.

Additional features of the inventive concepts will be set forth in the description which follows, and in part will be apparent from the description, or may be learned by practice of the inventive concepts.

A display device according to an exemplary embodiment of the present invention includes: a display panel including scan lines, emission control lines, and pixels connected to the scan lines and the emission control lines; a first emission driver sequentially providing first emission control signals to odd-numbered emission control lines among the emission control lines in a first frame section; a second emission driver sequentially providing second emission control signals to even-numbered emission control lines among the emission control lines in a second frame section that is continuous from the first frame section; and a scan driver sequentially providing scan signals to the scan lines in each of the first and second frame sections.

The display device may further include a timing controller generating a first start signal in the first frame section, generating a second start signal in the second frame section, and generating first to fourth clock signals in the first and second frame sections. The first start signal may have a turn-off level pulse in the first frame section, and the second start signal may have a turn-off level pulse in the second frame section. The first to fourth clock signals may have the same period, the second clock signal may be shifted by a quarter period from the first clock signal, the third clock signal may be shifted by a quarter period from the second clock signal, and the fourth clock signal may be shifted by a quarter period from the third clock signal. The first emission driver may generate the first emission control signals based on the first start signal and the first and third clock signals, and the second emission driver may generate the second emission control signals based on the second start signal and the second and fourth clock signals.

The first emission driver may provide third emission control signals to the odd-numbered emission control lines in the second frame section, and the second emission driver may provide fourth emission control signals to the even-numbered emission control lines in the first frame section.

The timing controller may further generate a third start signal in the second frame section, and further generate a fourth start signal in the first frame section. The third start signal may be maintained at a turn-off level during the second frame section, and the fourth start signal may be maintained at a turn-off level during the first frame section. The first emission driver may generate the third emission control signals based on the third start signal and the first and third clock signals, and the second emission driver may generate the fourth emission control signals based on the fourth start signal and the second and fourth clock signals.

The pixels may include: a first pixel connected to a (2n−1)th emission control line among the emission control lines, and a (2n−3)th scan line and a (2n−1)th scan line among the scan lines, where n is a natural number; and a second pixel connected to a 2n-th emission control line among the emission control lines, and a (2n−2)th scan line and a 2n-th scan line among the scan lines.

A scan signal provided to the (2n−1)th scan line and a scan signal provided to the 2n-th scan line may overlap in some sections.

The scan signals may be provided to the (2n−3)th scan line and the (2n−1)th scan line within a section in which a first emission control signal is provided to the (2n−1)th emission control line among the first frame section, and the scan signals may be provided to the (2n−2)th scan line and the 2n-th scan line within a section in which a second emission control signal is provided to the 2n-th emission control line among the second frame section.

The display device may further include a data driver providing data signals to the data lines in each of the first and second frame sections, and the first and second pixels may be connected to an m-th data line among the data lines, where m is a natural number.

The data driver may provide a first data signal to the m-th data line in a section in which the scan signal is provided to the (2n−1)th scan line among the first frame section, and provide a second data signal to the m-th data line in a section in which the scan signal is provided to the 2n-th scan line among the second frame section.

The first pixel may emit light with a grayscale corresponding to the first data signal based on the first emission control signal provided to the (2n−1)th emission control line and the scan signal provided to the (2n−1)th scan line in the first frame section, and does not emit light based on a third emission control signal provided to the (2n−1)th emission control line in the second frame section.

The second pixel does not emit light based on a fourth emission control signal provided to the 2n-th emission control line in the first frame section, and may emit light with a grayscale corresponding to the second data signal based on the second emission control signal provided to the 2n-th emission control line and the scan signal provided to the 2n-th scan line in the second frame section.

Another exemplary embodiment of the present invention provides a method of driving a display device including a first emission driver, a second emission driver, a scan driver, and a display panel including scan lines, emission control lines, and pixels connected to the scan lines and the emission control lines, the method including: sequentially providing first emission control signals to odd-numbered emission control lines by the first emission driver in a first frame section; and sequentially providing second emission control signals to even-numbered emission control lines by the second emission driver in a second frame section that is continuous from the first frame section. The scan driver may sequentially provide scan signals to the scan lines in each of the first and second frame sections.

The display device may further include a timing controller, and the method may further include: generating a first start signal and first to fourth clock signals by the timing controller in the first frame section; and generating a second start signal and the first to fourth clock signals by the timing controller in the second frame section. The first start signal may have a turn-off level pulse in the first frame section, and the second start signal may have a turn-off level pulse in the second frame section. The first to fourth clock signals may have the same period, the second clock signal may be shifted by a quarter period from the first clock signal, the third clock signal may be shifted by a quarter period from the second clock signal, and the fourth clock signal may be shifted by a quarter period from the third clock signal. The first emission driver may generate the first emission control signals based on the first start signal and the first and third clock signals, and the second emission driver may generate the second emission control signals based on the second start signal and the second and fourth clock signals.

The timing controller may further generate a fourth start signal in the first frame section, and further generate a third start signal in the second frame section, and the method may further include: providing fourth emission control signals to the even-numbered emission control lines by the second emission driver based on the fourth start signal and the second and fourth clock signals in the first frame section; and providing third emission control signals to the odd-numbered emission control lines by the first emission driver based on the third start signal and the first and third clock signals in the second frame section. The third start signal may be maintained at a turn-off level during the second frame section, and the fourth start signal may be maintained at a turn-off level during the first frame section.

The pixels may include: a first pixel connected to a (2n−1)th emission control line among the emission control lines, and a (2n−3)th scan line and a (2n−1)th scan line among the scan lines, where n is a natural number; and a second pixel connected to a 2n-th emission control line among the emission control lines, and a (2n−2)th scan line and a 2n-th scan line among the scan lines.

The scan signals may be provided to the (2n−3)th scan line and the (2n−1)th scan line within a section in which a first emission control signal is provided to the (2n−1)th emission control line among the first frame section, and the scan signals may be provided to the (2n−2)th scan line and the 2n-th scan line within a section in which a second emission control signal is provided to the 2n-th emission control line among the second frame section.

The display device may further include a data driver providing data signals to the data lines, the first and second pixels may be connected to an m-th data line among the data lines, where m is a natural number, and the data driver may provide a first data signal to the m-th data line in the first frame section, and provide a second data signal to the m-th data line in the second frame section.

The first data signal may be provided to overlap a section in which a scan signal is provided to the (2n−1)th scan line, and the second data signal may be provided to overlap a section in which a scan signal is provided to the 2n-th scan line.

The method may further include: emitting light of the first pixel at a grayscale corresponding to the first data signal based on the first emission control signal provided to the (2n−1)th emission control line and the scan signal provided to the (2n−1)th scan line in the first frame section; and not emitting light the second pixel based on a fourth emission control signal provided to the 2n-th emission control line in the first frame section.

The method may further include: not emitting light the first pixel based on a third emission control signal provided to the (2n−1)th emission control line in the second frame section; and emitting light of the second pixel at a grayscale corresponding to the second data signal based on the second emission control signal provided to the 2n-th emission control line and the scan signal provided to the 2n-th scan line in the second frame section.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
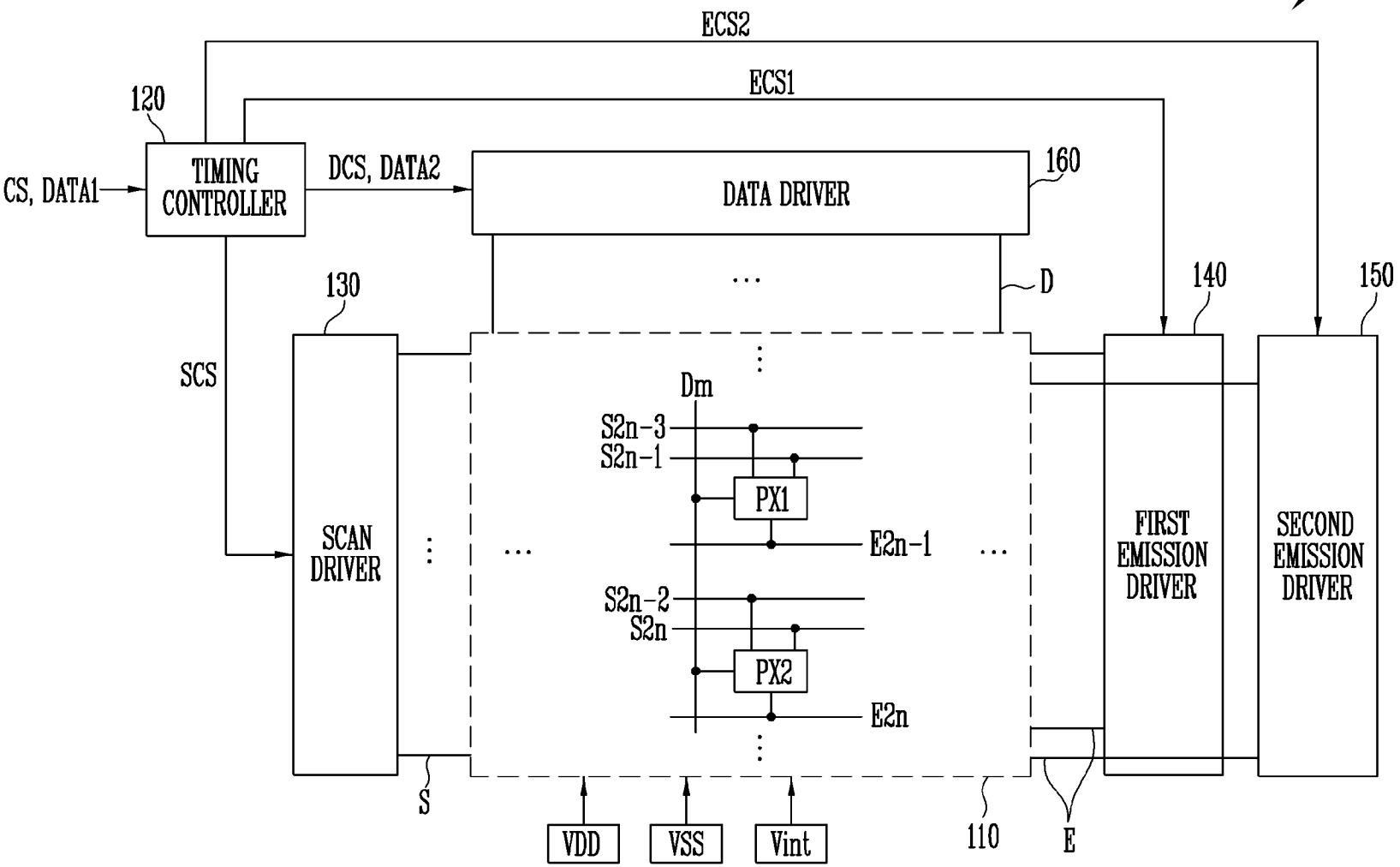
FIG. 1 is a block diagram for explaining a display device according to an exemplary embodiment of the present invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments of the present invention will be described in detail with reference to the accompanying drawings.

FIG. 1 is a block diagram for explaining a display device according to an exemplary embodiment of the present invention.

Referring to FIG. 1, a display device 100 may include a display panel 110, a timing controller 120, a scan driver 130, emission drivers 140 and 150, and a data driver 160.

The display panel 110 may include scan lines S, emission control lines E, data lines D, and pixels PX1 and PX2.

The pixels PX1 and PX2 may be connected to at least one of the scan lines S, at least one of the emission control lines E, and one of the data lines D. For example, a first pixel PX1 may be connected to a (2n−1)th scan line S2*n*−1 and a (2n−3)th scan line S2*n*−3 among the scan lines S, a (2n−1)th emission control line E2*n*−1 among the emission control lines E, and an m-th data line Dm among the data lines D, where n and m are natural numbers. As another example, a second pixel PX2 may be connected to a 2n-th scan line S2*n* and a (2n−2)nd scan line S2*n*−2 among the scan lines S, a 2n-th emission control line E2*n* among the emission control lines E, and the m-th data line Dm among the data lines D.

In an exemplary embodiment, the pixels (for example, first pixels PX1) positioned on odd-numbered horizontal lines emit light in a first frame section (for example, an odd-numbered frame section or an even-numbered frame section), and do not emit light in a second frame section (for example, the even-numbered frame section or the odd-numbered frame section) that is continuous from the first frame section. In addition, the pixels (for example, second pixels PX2) positioned on even-numbered horizontal lines do not emit light in the first frame section and emit light in the second frame section. This will be described later with reference to FIGS. 2, 7A, and 7B.

The pixels PX1 and PX2 may receive voltages of a first power source VDD, a second power source VSS, and an initialization power source Vint from outside. The first and second power sources VDD and VSS may be voltages necessary for an operation of the pixels PX1 and PX2, and the first power source VDD may have a voltage level higher than that of the second power source VSS. In addition, the initialization power source Vint may have a voltage level for initializing a driving transistor and/or a light emitting element included in the pixels PX1 and PX2.

The timing controller 120 may receive a control signal CS and input image data DATA1 from an external device (for example, a graphics processor), generate a scan control signal SCS and a data control signal DCS based on the control signal CS, and convert the input image data DATA1 to generate image data DATA2. Here, the control signal CS may include a vertical synchronization signal, a horizontal synchronization signal, a clock signal, and the like.

In an exemplary embodiment, the timing controller 120 may generate a first emission driving control signal ECS1 and a second emission driving control signal ECS2 based on the control signal CS.

The scan driver 130 may generate scan signals based on the scan control signal SCS provided from the timing controller 120, and sequentially provide the scan signals to the scan lines S. Here, the scan control signal SCS may include a scan start signal, first to fourth scan clock signals, and the like.

In an exemplary embodiment, the scan driver 130 may sequentially provide the scan signals having pulses of a turn-on level (or a turn-on voltage level) to the scan lines S in each of the first and second frame sections (for example, in each of the odd-numbered and even-numbered frame sections). For example, the scan driver 130 may be configured in the form of a shift register. The configuration of the scan driver 130 generating the scan signals will be described later with reference to FIGS. 5A, 5B, and 6.

The emission drivers 140 and 150 may be divided into configurations and operations of a first emission driver 140 and a second emission driver 150. However, the division of the emission drivers 140 and 150 is for convenience of description. According to another design method, the first and second emission drivers 140 and 150 may be integrated into one configuration (for example, one driving circuit, one module, and the like).

The first emission driver 140 may generate emission control signals based on the first emission driving control signal ECS1 provided from the timing controller 120, and sequentially provide the emission control signals to at least some of the emission control lines E. For example, the first emission driver 140 may generate the emission control signals provided to odd-numbered emission control lines E, and sequentially provide the emission control signals to the odd-numbered emission control lines E. However, the inventive concepts are not limited thereto, and the first emission driver 140 may generate the emission control signals provided to even-numbered emission control lines E, and sequentially provide the emission control signals to the even-numbered emission control lines E. Here, the first emission driving control signal ECS1 may include a first emission start signal, first and third emission clock signals, and the like.

In an exemplary embodiment, the first emission driver 140 may sequentially provide first emission control signals having pulses of a turn-off level (or a turn-off voltage level) to the odd-numbered emission control lines E (or the even-numbered emission control lines E) in the first frame section (for example, the odd-numbered frame section or the even-numbered frame section). In the first frame section, when the first emission control signals having the pulses of the turn-off level are sequentially provided to the odd-numbered emission control lines E, the pixels connected to the odd-numbered emission control lines E (for example, the first pixels PX1) do not emit light in units of horizontal lines.

In addition, the first emission driver 140 may provide third emission control signals that are maintained at the turn-off level during the second frame section to the odd-numbered emission control lines E (or the even-numbered emission control lines E) in the second frame section (for example, the even-numbered frame section or the odd-numbered frame section). In the second frame section, when the third emission control signals that are maintained at the turn-off level during the second frame section are provided to the odd-numbered emission control lines E, the pixels connected to the odd-numbered emission control lines E (for example, the first pixels PX1) do not emit light during the second frame section.

The second emission driver 150 may generate emission control signals based on the second emission driving control signal ECS2 provided from the timing controller 120, and sequentially provide the emission control signals to at least some of the emission control lines E. For example, the second emission driver 150 may generate the emission control signals provided to the even-numbered emission control lines E, and sequentially provide the emission control signals to the even-numbered emission control lines E. However, the inventive concepts are not limited thereto, and the second emission driver 150 may generate the emission control signals provided to the odd-numbered emission control lines E, and sequentially provide the emission control signals to the odd-numbered emission control lines E. Here, the second emission driving control signal ECS2 may include a second emission start signal, second and fourth emission clock signals, and the like.

In an exemplary embodiment, the second emission driver 150 may sequentially provide second emission control signals having pulses of a turn-off level (or a turn-off voltage level) to the even-numbered emission control lines E (or the odd-numbered emission control lines E) in the second frame section (for example, the even-numbered frame section or the odd-numbered frame section). In the second frame section, when the second emission control signals having the pulses of the turn-off level are sequentially provided to the even-numbered emission control lines E, the pixels connected to the even-numbered emission control lines E (for example, the second pixels PX2) do not emit light in units of horizontal lines.

In addition, the second emission driver 150 may provide fourth emission control signals that are maintained at the turn-off level during the first frame section to the even-numbered emission control lines E (or the odd-numbered emission control lines E) in the first frame section (for example, the odd-numbered frame section or the even-numbered frame section). In the first frame section, when the fourth emission control signals that are maintained at the turn-off level during the first frame section are provided to the even-numbered emission control lines E, the pixels connected to the even-numbered emission control lines E (for example, the second pixels PX1) do not emit light during the first frame section.

In an exemplary embodiment, the first and second emission drivers 140 and 150 may be configured in the form of a shift register.

Configurations of the first and second emission drivers 140 and 150 for generating the first and second emission control signals will be described later with reference to FIGS. 3, 4A, and 4B.

The data driver 160 may generate data signals based on the image data DATA2 and the data control signal DCS provided from the timing controller 120, and provide the data signals to the display panel 110 (or the pixels PX1 and PX2) in each of the first and second frame sections (for example, in each of the odd-numbered and even-numbered frame sections). The data control signal DCS may be a signal for controlling an operation of the data driver 160 and may include a load signal (or a data enable signal) indicating an output of valid data signal.

At least one of the timing controller 120, the scan driver 130, the emission drivers 140 and 150, and the data driver 160 may be formed on the display panel 110 or implemented as an IC and connected to the display panel 110 in the form a tape carrier package. In addition, at least two of the timing controller 120, the scan driver 130, the emission drivers 140 and 150, and the data driver 160 may be implemented as one IC.

Figure 2:
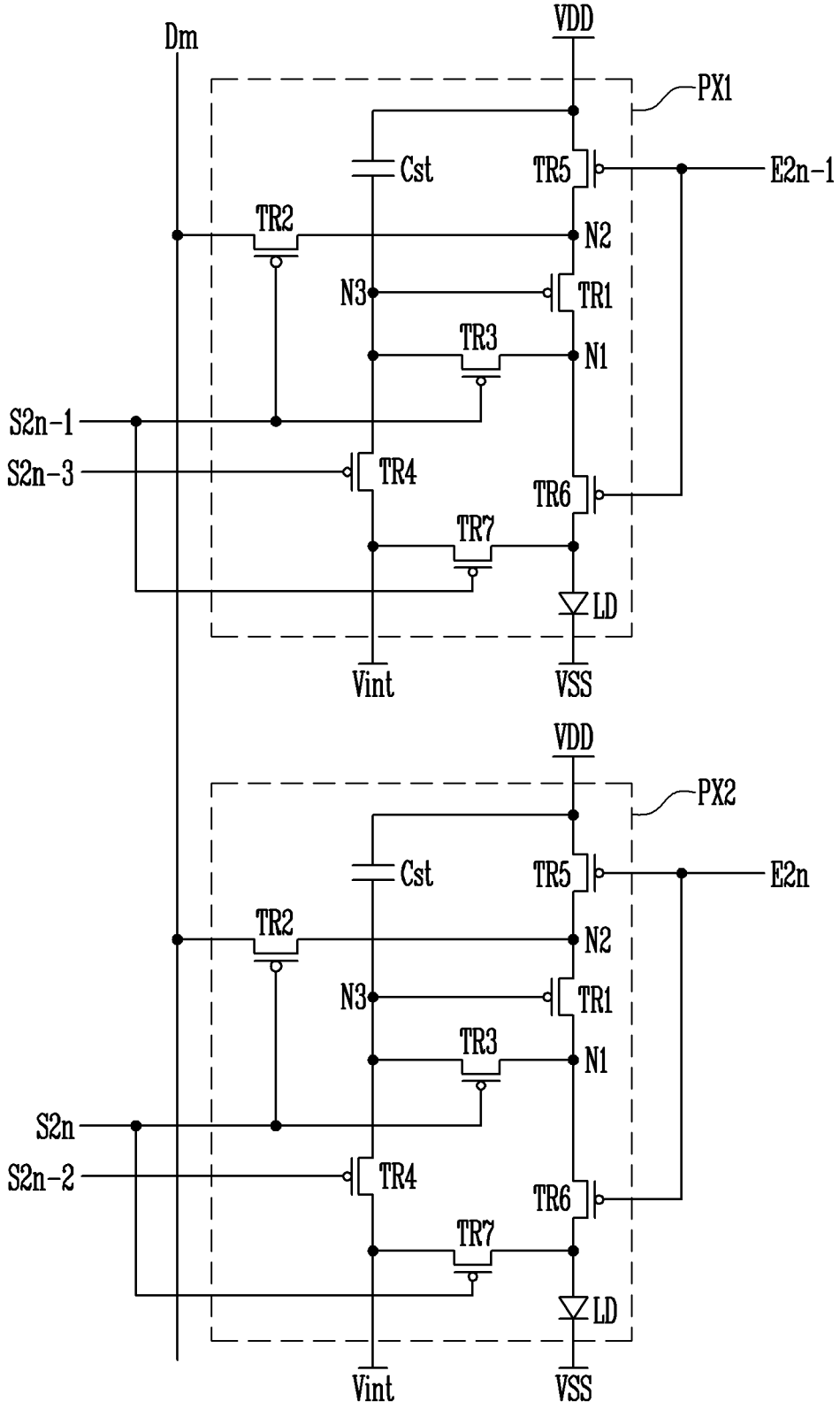
FIG. 2 is a circuit diagram illustrating an example of a first pixel and a second pixel included in the display device of FIG. 1.

FIG. 2 is a circuit diagram illustrating an example of a first pixel and a second pixel included in the display device of FIG. 1.

Referring to FIG. 2, each of the first and second pixels PX1 and PX2 may include first to seventh transistors TR1 to TR7, a storage capacitor Cst, and a light emitting element LD.

Each of the first to seventh transistors TR1 to TR7 may be implemented as a P-type transistor, but the inventive concepts are not limited thereto. For example, at least some of the first to seventh transistors TR1 to TR7 may be implemented as N-type transistors.

Since the first pixel PX1 and the second pixel PX2 are substantially identical to each other, the first pixel PX1 encompassing the first pixel PX1 and the second pixel PX2 will be described.

A first electrode of the first transistor TR1 (a driving transistor) may be connected to a second node N2 or may be connected to a first power source line (that is, a power source line to which the first power source VDD is applied) via the fifth transistor TR5. A second electrode of the first transistor TR1 may be connected to a first node N1 or may be connected to an anode of the light emitting element LD via the sixth transistor TR6. A gate electrode of the first transistor TR1 may be connected to a third node N3. The first transistor TR1 may control the amount of current flowing from the first power source line to a second power source line (that is, a power source line for delivering the second power source VSS) via the light emitting element LD in response to a voltage of the third node N3.

The second transistor TR2 (a switching transistor) may be connected between the m-th data line Dm and the second node N2. A gate electrode of the second transistor TR2 may be connected to a (2n−1)th scan line S2*n*−1. The second transistor TR2 may be turned on when a scan signal is supplied to the (2n−1)th scan line S2*n*−1, and electrically connect the m-th data line Dm and the first electrode of the first transistor TR1.

The third transistor TR3 may be connected between the first node N1 and the third node N3. A gate electrode of the third transistor TR3 may be connected to the (2n−1)th scan line S2*n*−1. The third transistor TR3 may be turned on when the scan signal is supplied to the (2n−1)th scan line S2*n*−1, and electrically connect the first node N1 and the third node N3. Therefore, when the third transistor TR3 is turned on, the first transistor TR1 may be connected in the form of a diode.

The storage capacitor Cst may be connected between the first power source line and the third node N3. The storage capacitor Cst may store a voltage corresponding to a data signal and a threshold voltage of the first transistor TR1.

The fourth transistor TR4 may be connected between the third node N3 and the initialization power source line (that is, a power source line for delivering the initialization power source Vint). A gate electrode of the fourth transistor TR4 may be connected to the (2n−3)th scan line S2*n*−3. The fourth transistor TR4 may be turned on when the scan signal is supplied to the (2n−3)th scan line S2*n*−3, and supply the initialization power source Vint to the first node N1. Here, the initialization power source Vint may be set to have a voltage level lower than that of the data signal.

The fifth transistor TR5 may be connected between the first power source line and the second node N2. A gate electrode of the fifth transistor TR5 may be connected to a (2n−1)th emission control line E2*n*−1. The fifth transistor TR5 may be turned off when an emission control signal is supplied to the (2n−1)th emission control line E2*n*−1, and may be turned on in other cases.

The sixth transistor TR6 may be connected between the first node N1 and the light emitting element LD. A gate electrode of the sixth transistor TR6 may be connected to the (2n−1)th emission control line E2*n*−1. The sixth transistor TR6 may be turned off when the emission control signal is supplied to the (2n−1)th emission control line E2*n*−1, and may be turned on in other cases.

The seventh transistor TR7 may be connected between the initialization power source line and the anode of the light emitting element LD. A gate electrode of the seventh transistor TR7 may be connected to the (2n−1)th scan line S2*n*−1. The seventh transistor TR7 may be turned on when the scan signal is supplied to the (2n−1)th scan line S2*n*−1, and supply the initialization power source Vint to the anode of the light emitting element LD.

The anode of the light emitting element LD may be connected to the first transistor TR1 via the sixth transistor TR6, and a cathode of the light emitting element LD may be connected to the second power source line. The light emitting element LD may emit light having a predetermined luminance level in response to a current supplied from the first transistor TR1. The first power source VDD may be set to have a higher voltage level than the second power source VSS so that the current flows to the light emitting element LD.

In the second pixel PX2, the gate electrodes of the second, third, and seventh transistors TR2, TR3, and TR7 may be connected to the 2n-th scan line S2*n*, the gate electrode of the fourth transistor TR4 may be connected to the (2n−2)th scan line S2*n*−2, and the gate electrodes of the fifth and sixth transistors TR5 and TR6 may be connected to the 2n-th emission control line E2*n*.

The connection relationship between the first and second pixels PX1 and PX2 is not limited thereto. For example, the gate electrode of the fourth transistor TR4 of the first pixel PX1 may be connected to a (2n−4)th scan line, and the gate electrode of the fourth transistor TR4 of the second pixel PX2 may be connected to the (2n−3)th scan line S2*n*−3.

Figure 3:
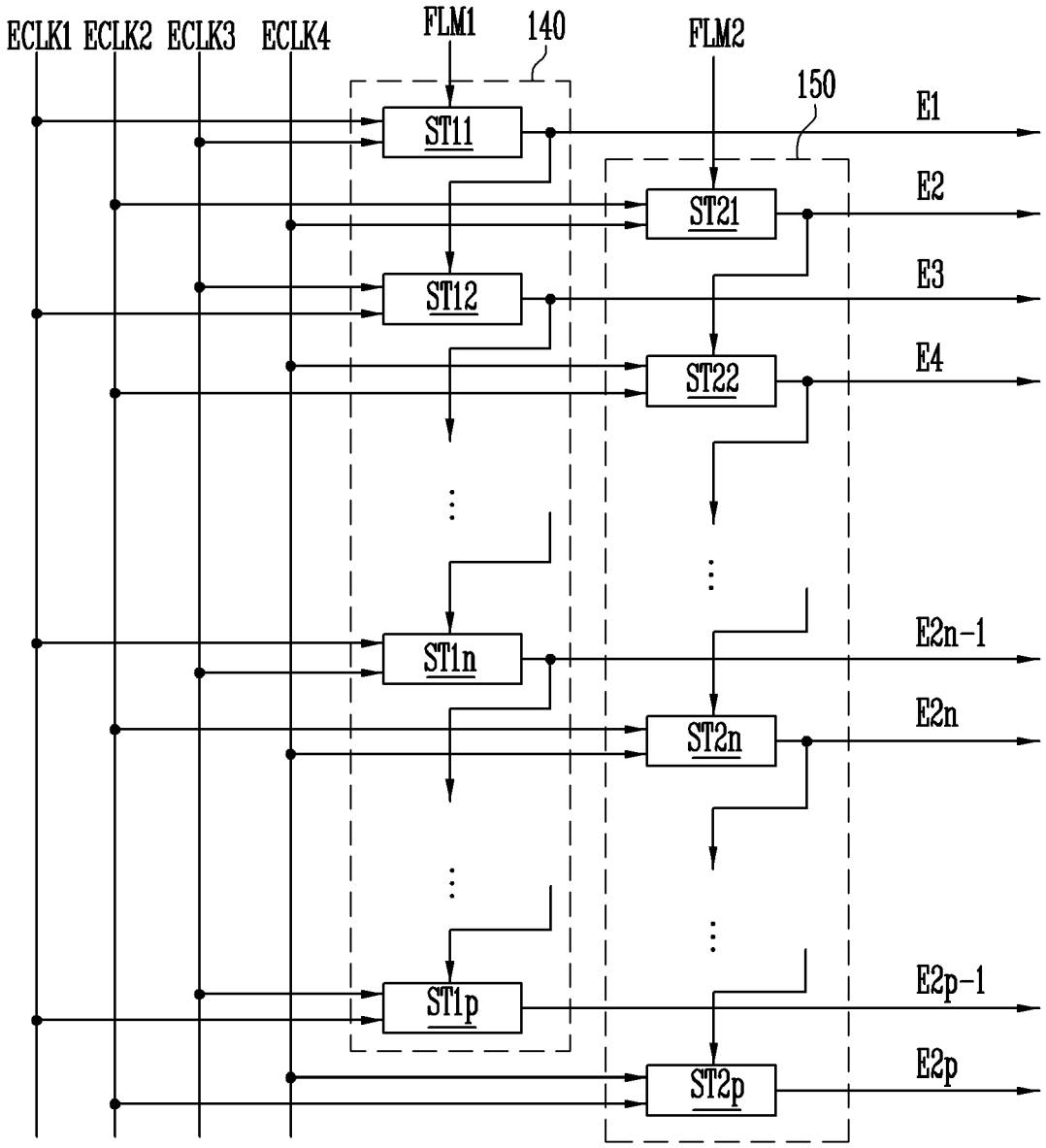
FIG. 3 is a diagram illustrating an example of a first emission driver and a second emission driver included in the display device of FIG. 1.

FIG. 3 is a diagram illustrating an example of a first emission driver and a second emission driver included in the display device of FIG. 1.

Referring to FIG. 3, the first emission driver 140 may include a plurality of stages ST11, ST12, . . . , ST1*n*, . . . , and ST1*p*, where p is a natural number and n is a natural number greater than 1 and less than p. The plurality of stages ST11, ST12, . . . , ST1*n*, . . . , and ST1*p* may be connected to at least some of the emission control lines E (see FIG. 1) and may be driven in response to clock signals. For example, the plurality of stages ST11, ST12, . . . , ST1*n*, . . . , ST1*p* may be connected to the odd-numbered emission control lines E1, E3, E2*n*−1, . . . , and E2*p*−1, respectively, and generate the emission control signals using the first emission start signal FLM1 (or an output signal of the previous stage, that is, the emission control signal of the previous stage) and the first and third emission clock signals ECLK1 and ECLK3. As such, the plurality of stages ST11, ST12, . . . , ST1*n*, . . . , and ST1*p* may sequentially provide the first emission control signals to the odd-numbered emission control lines E1, E3, E2*n*−1, . . . , and E2*p*−1.

The second emission driver 150 may include a plurality of stages ST21, ST22, . . . , ST2*n*, . . . , and ST2*p*. The plurality of stages ST21, ST22, ST2*n*, . . . , and ST2*p* may be connected to at least some of the emission control lines E (see FIG. 1) and may be driven in response to clock signals. For example, the plurality of stages ST21, ST22, ST2*n*, . . . , and ST2*p* may be connected to the even-numbered emission control lines E2, E4, E2*n*, E2*p*, respectively, and generate the emission control signals using the second emission start signal FLM2 (or an output signal of the previous stage, that is, the emission control signal of the previous stage) and the second and fourth emission clock signals ECLK2 and ECLK4. As such, the plurality of stages ST21, ST22, ST2*n*, . . . , and ST2*p* may sequentially provide the second emission control signals to the even-numbered emission control lines E2, E4, E2*n*, . . . , and E2*p*.

In an exemplary embodiment, the plurality of stages ST11, ST12, . . . , ST1*n*, and ST1*p* of the first emission driver 140 and the plurality of stages ST21, ST22, ST2*n*, and ST2*p* of the second emission driver 150 may have substantially the same circuit structure.

Figure 4A:
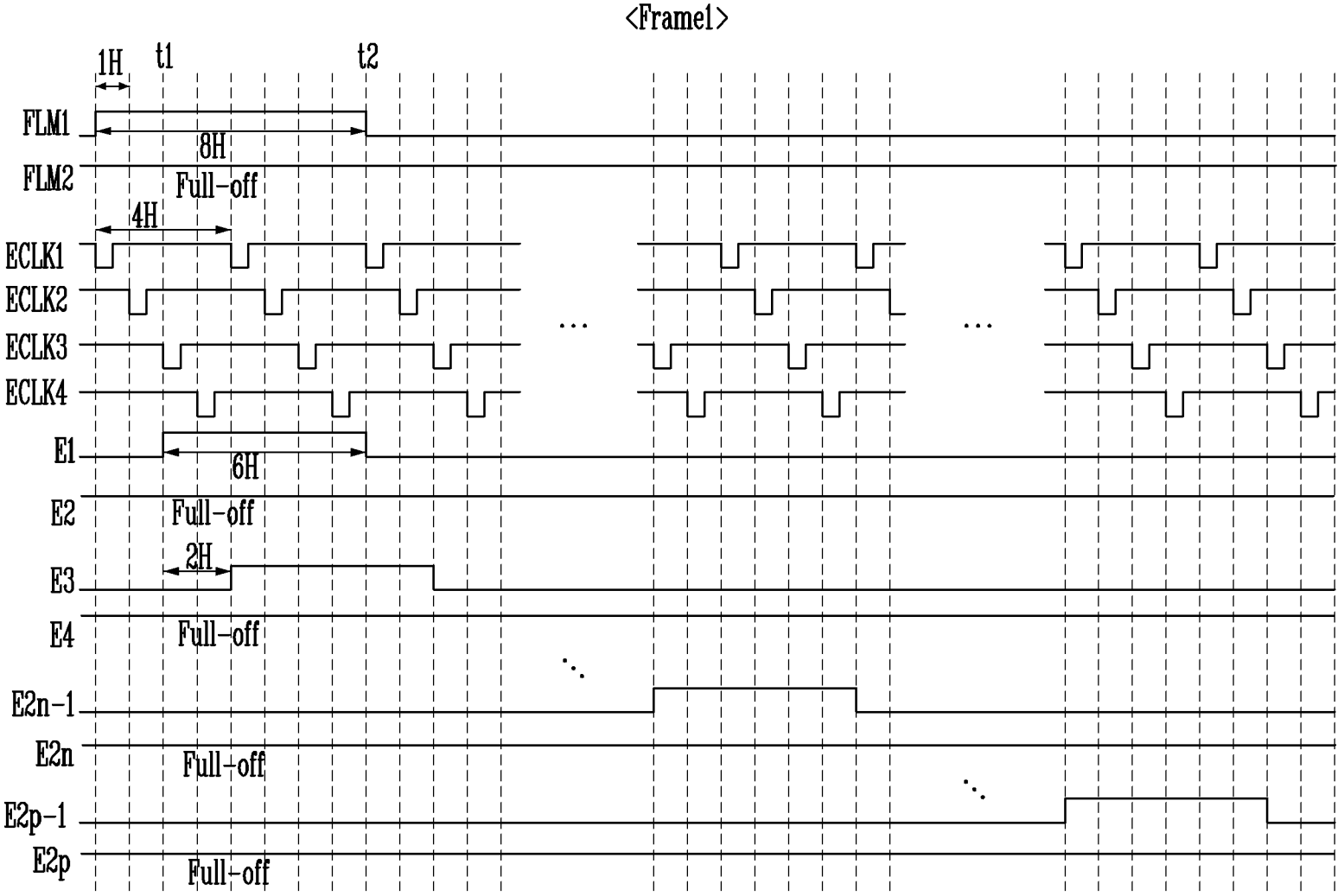
FIG. 4A is a diagram illustrating an example of signals measured in the first emission driver and the second emission driver of FIG. 3 in a first frame section.
Figure 4B:
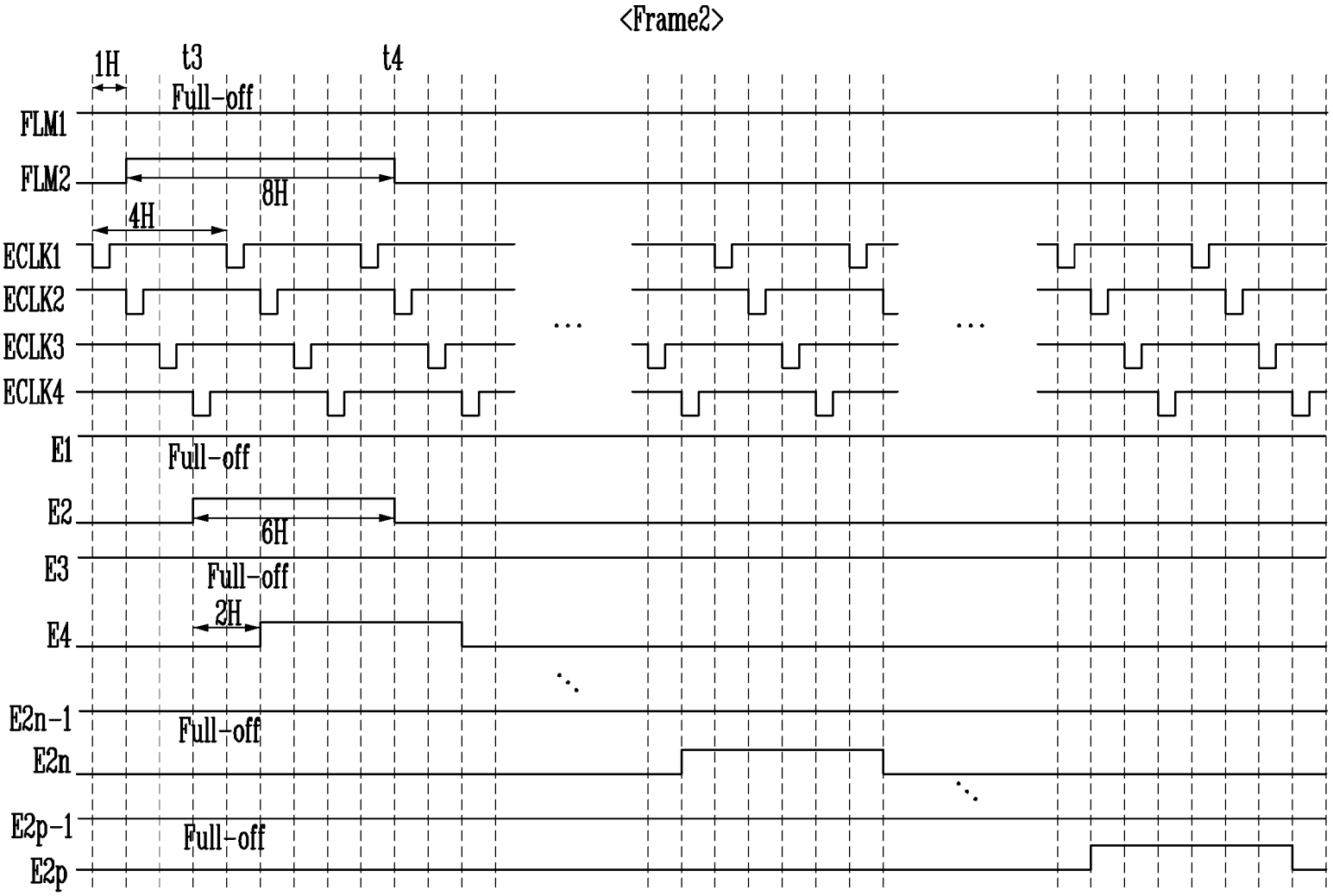
FIG. 4B is a diagram illustrating an example of signals measured in the first emission driver and the second emission driver of FIG. 3 in a second frame section.

FIGS. 4A and 4B are referred to explain the first to fourth emission clock signals ECLK1, ECLK2, ECLK3, and ECLK4 and the first and second emission start signals FLM1 and FLM2 which are provided to the first and second emission drivers 140 and 150, and the emission control signals generated by the first and second emission drivers 140 and 150.

FIG. 4A is a diagram illustrating an example of signals measured in the first emission driver and the second emission driver of FIG. 3 in a first frame section. FIG. 4B is a diagram illustrating an example of signals measured in the first emission driver and the second emission driver of FIG. 3 in a second frame section.

Referring to FIGS. 1, 3 and 4A, the first frame section Frame1 may correspond to the odd-numbered frame section. However, the inventive concepts are not limited thereto, and the first frame section Frame1 may correspond to the even-numbered frame section.

In the first frame section Frame1, the timing controller 120 may generate the first and second emission start signals FLM1 and FLM2 and the first to fourth emission clock signals ECLK1, ECLK2, ECLK3, and ECLK4.

In the first frame section Frame1, the first emission start signal FLM1 may have a turn-off level pulse (for example, a logic high level pulse). A pulse width of the turn-off level pulse included in the first emission start signal FLM1 may be set based on the scan signals provided to the pixels PX1 and PX2 (see FIG. 2). Here, the length of the pulse width of the turn-off level pulse included in the first emission start signal FLM1 may be defined as a second section 8H. The length of the second section 8H may be eight times the length of a first section 1H. However, the length of the pulse width of the turn-off level pulse included in the first emission start signal FLM1 is not limited thereto. For example, the first emission start signal FLM1 may include the turn-off level pulse having a pulse width corresponding to 12 times the length of the first section 1H.

In the first frame section Frame1, the second emission start signal FLM2 may be a signal (or a fourth emission start signal) maintained at the turn-off level. In an embodiment, the second emission start signal FLM2 may be shifted to the turn-off level before the first frame section Frame1 starts, and maintained at the turn-off level during the first frame section Frame1. For example, in a blank section of the previous frame section of the first frame section Frame1, the second emission start signal FLM2 may be shifted to the turn-off level and maintained at the turn-off level during the first frame section Frame1.

The first to fourth emission clock signals ECLK1, ECLK2, ECLK3, and ECLK4 may have the same period, and may be shifted by a quarter period and sequentially generated. Here, the shifted section may be defined as the first section 1H, and the period may be defined as a third section 4H. In an embodiment, the first to fourth emission clock signals ECLK1, ECLK2, ECLK3, and ECLK4 may have a period (that is, the length of the third period 4H) corresponding to four times the time of the first section 1H. The second emission clock signal ECLK2 may be generated by being shifted by the first section 1H from the first emission clock signal ECLK1, the third emission clock signal ECLK3 may be generated by being shifted by the first section 1H from the second emission clock signal ECLK2, and the fourth emission clock signal ECLK4 may be generated by being shifted by the first section 1H from the third emission clock signal ECLK3. However, the number and period of the emission clock signals generated by the timing controller 120 are not limited thereto. For example, the timing controller 120 may generate six emission clock signals, and the emission clock signals may have a period corresponding to six times the time of the first section 1H. As another example, the timing controller 120 may generate four emission clock signals, and the emission clock signals may have a period corresponding to twice the time of the first section 1H.

The first emission driver 140 may generate the first emission control signals to be provided to the odd-numbered emission control lines E1, E3, E2$n$−1, . . . , and E2$p$−1 based on the first emission start signal FLM1 and the first and third emission clock signals ECLK1 and ECLK3.

In an exemplary embodiment, the first emission control signals may be changed from a turn-on level to the turn-off level when the first emission start signal (or a first emission control signal of the previous stage) is the turn-off level and the first emission clock signal ECLK1 or the third emission clock signal ECLK3 is shifted to a turn-on level (or a logic low level). In addition, the first emission control signals may be changed from the turn-off level to the turn-on level when the first emission start signal (or the first emission control signal of the previous stage) is shifted to the turn-on level and the first emission clock signal ECLK1 or the third emission clock signal ECLK3 is shifted to the turn-on level (or the logic low level).

For example, the first emission control signal provided to a first emission control line E1 may be changed from the turn-on level to the turn-off level when the first emission start signal FLM1 is the turn-off level and the third emission clock signal ECLK3 is shifted to the turn-on level (that is, a first time point t1). In addition, the first emission control signal provided to the first emission control line E1 may be changed from the turn-off level to the turn-on level when the first emission start signal FLM1 is shifted to the turn-on level and the first emission clock signal ECLK1 is shifted to the turn-on level (that is, a second time point t2). Accordingly, the first emission control signal provided to the first emission control line E1 may include a turn-off level pulse having a pulse width corresponding to the length of a fourth section 6H. Here, the length of the fourth section 6H may be six times the length of the first section 1H.

In an exemplary embodiment, the emission control signals provided to the odd-numbered emission control lines E1, E3, E2$n$−1, . . . , and E2$p$−1 may be shifted by a fifth section 2H and sequentially generated. For example, the first emission control signal provided to a third emission control line E3 may be shifted by the fifth section 2H from the first emission control signal provided to the first emission control line E1.

The second emission driver 150 may generate the second emission control signals to be provided to the even-numbered emission control lines E2, E4, E2$n$, . . . , and E2$p$ based on the second emission start signal FLM2 (or the fourth emission start signal) maintained at the turn-off level in the first frame section Frame1 and the second and fourth emission clock signals ECLK2 and ECLK4.

In an exemplary embodiment, as the second emission start signal FLM2 is maintained at the turn-off level in the first frame section Frame1, the second emission control signals provided to the even-numbered emission control lines E2, E4, E2$n$, . . . , and E2$p$ may be signals (or the fourth emission control signals) maintained at the turn-off level in the first frame section Frame1.

Referring to FIGS. 1, 3 and 4B, the second frame section Frame2 may correspond to the even-numbered frame section. However, the inventive concepts are not limited thereto, and the second frame section Frame2 may correspond to the odd-numbered frame section.

In the second frame section Frame2, the timing controller 120 may generate the first and second emission start signals FLM1 and FLM2 and first to fourth emission clock signals ECLK1, ECLK2, ECLK3, and ECLK4.

In the second frame section Frame2, the second emission start signal FLM2 may have a turn-off level pulse (for example, a logic high level pulse). A pulse width of the turn-off level pulse included in the second emission start signal FLM2 may be set equal to the pulse width of the turn-off level pulse included in the first emission start signal FLM1 in the first frame section Frame1.

In the second frame section Frame2, the first emission start signal FLM1 may be a signal (or a third emission start signal) maintained at the turn-off level. In an exemplary embodiment, the first emission start signal FLM1 may be shifted to the turn-off level before the second frame section Frame2 starts, and maintained at the turn-off level during the second frame section Frame2. For example, in a blank section of the previous frame section of the second frame section Frame2, the first emission start signal FLM1 may be shifted to the turn-off level and maintained at the turn-off level during the second frame section Frame2.

The first to fourth emission clock signals ECLK1, ECLK2, ECLK3, and ECLK4 are substantially the same as or similar to the first to fourth emission clock signals ECLK1, ECLK2, ECLK3, and ECLK4 described with reference to FIG. 4A. Therefore, duplicate descriptions will not be repeated.

The second emission driver 150 may generate the second emission control signals to be provided to the even-numbered emission control lines E2, E4, E2$n$, . . . , and E2$p$ based on the second emission start signal FLM2 and the second and fourth emission clock signals ECLK2 and ECLK4.

In an exemplary embodiment, the second emission control signals may be changed from the turn-on level to the turn-off level when the second emission start signal FLM2 (or the second emission control signal of the previous stage) is the turn-off level and the second emission clock signal ECLK2 or the fourth emission clock signal ECLK4 is shifted to the turn-on level (or the logic low level). In addition, the second emission control signals may be changed from the turn-off level to the turn-on level when the second emission start signal FLM2 (or the second emission control signal of the previous stage) is shifted to the turn-on level and the second emission clock signal ECLK2 or the fourth emission clock signal ECLK4 is shifted to the turn-on level (or the logic low level).

For example, the second emission control signal provided to a second emission control line E2 may be changed from the turn-on level to the turn-off level when the second emission start signal FLM2 is the turn-off level and the fourth emission clock signal ECLK4 is shifted to the turn-on level (that is, the third time point t3). In addition, the second emission control signal provided to the second emission control line E2 may be changed from the turn-off level to the turn-on level when the second emission start signal FLM2 is shifted to the turn-on level and the second emission clock signal ECLK2 is shifted to the turn-on level (that is, a fourth time point t4). Accordingly, the second emission control signal provided to the second emission control line E2 may include a turn-on level pulse having a pulse width corresponding to the length of the fourth section 6H. Here, the length of the fourth section 6H may be six times the length of the first section 1H.

In an exemplary embodiment, the second emission control signals provided to the even-numbered emission control lines E2, E4, E2*n*, . . . , and E2*p* may be shifted by the fifth section 2H and sequentially generated. For example, the second emission control signal provided to the fourth emission control line E4 may be shifted by the fifth section 2H from the second emission control signal provided to the second emission control line E2.

The first emission driver 140 may generate the first emission control signals to be provided to the odd-numbered emission control lines E1, E3, E2*n*−1, . . . , and E2*p*−1 based on the first emission start signal FLM1 (or the third emission start signal) maintained at the turn-off level in the second frame section Frame2 and the first and third emission clock signals ECLK1 and ECLK3.

In an exemplary embodiment, as the first emission start signal FLM1 is maintained at the turn-off level in the second frame section Frame2, the first emission control signals provided to the odd-numbered emission control lines E1, E3, E2*n*−1, . . . , and E2*p*−1 may be signals (or the third emission control signals) maintained at the turn-off level in the second frame section Frame2.

As described with reference to FIGS. 3, 4A, and 4B, the first emission driver 140 may provide the first emission control signals (or the third emission control signals) maintained at the turn-off level in the second frame section Frame2 (for example, the even-numbered frame section) to the odd-numbered emission control lines E1, E3, E2*n*−1, . . . , and E2*p*−1. In addition, the second emission driver 150 may provide the second emission control signals (or the fourth emission control signals) maintained at the turn-off level in the first frame section Frame1 (for example, the odd-numbered frame period) to the even-numbered emission control lines E2, E4, E2*n*, . . . , and E2*p*. Accordingly, the pixels (for example, the second pixels PX2 of FIG. 2) connected to the even-numbered emission control lines E2, E4, E2*n*, . . . , and E2*p* may be maintained in a non-light emitting state in the first frame section Frame1, and the pixels (for example, the first pixels PX1 of FIG. 2) connected to the odd-numbered emission control lines E1, E3, E2*n*−1, . . . , and E2*p*−1 may be maintained in the non-emission state in the second frame section Frame2.

Figure 5A:
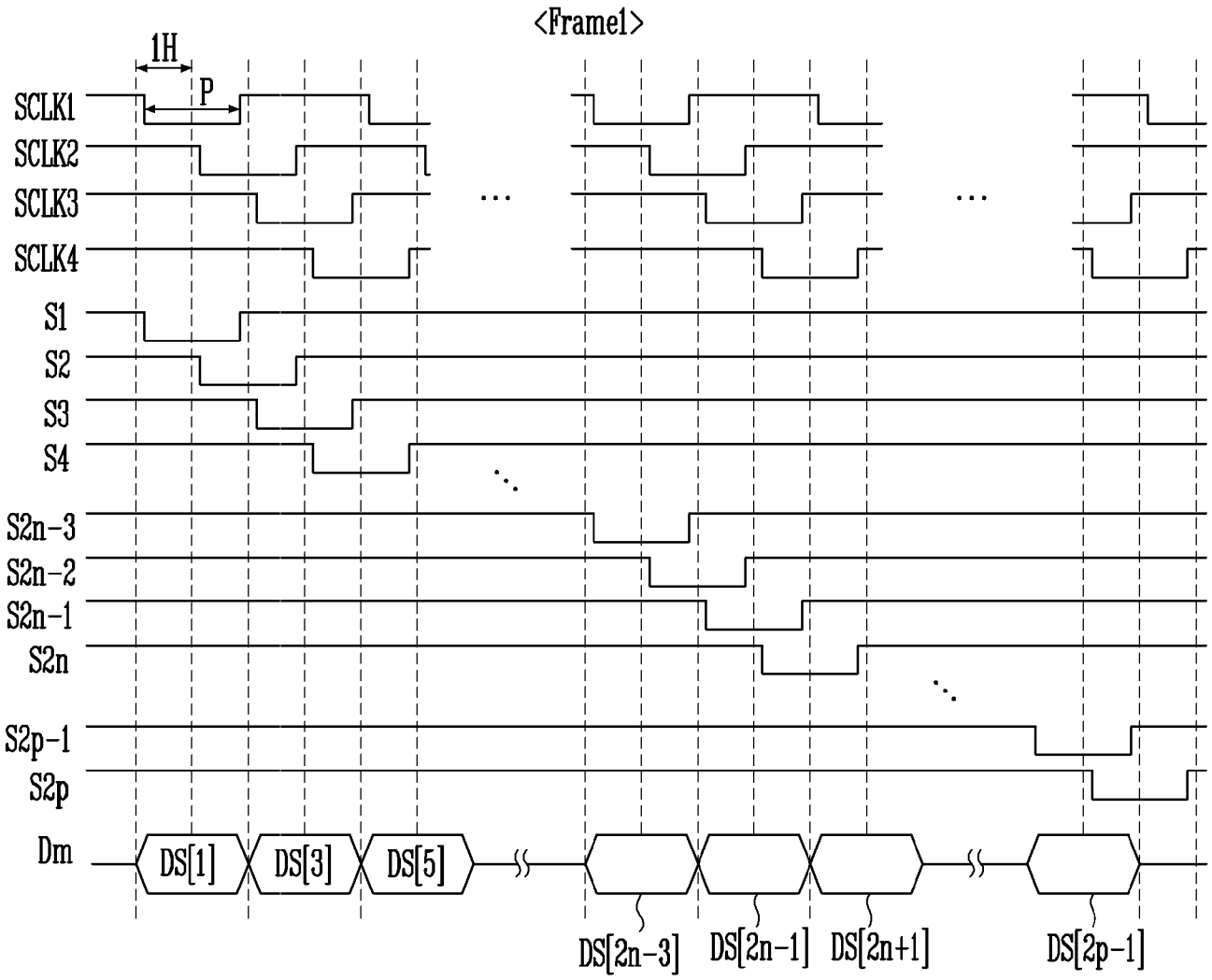
FIG. 5A is a diagram illustrating an example of signals measured in a scan driver and a data driver included in the display device of FIG. 1 in the first frame section.
Figure 5B:
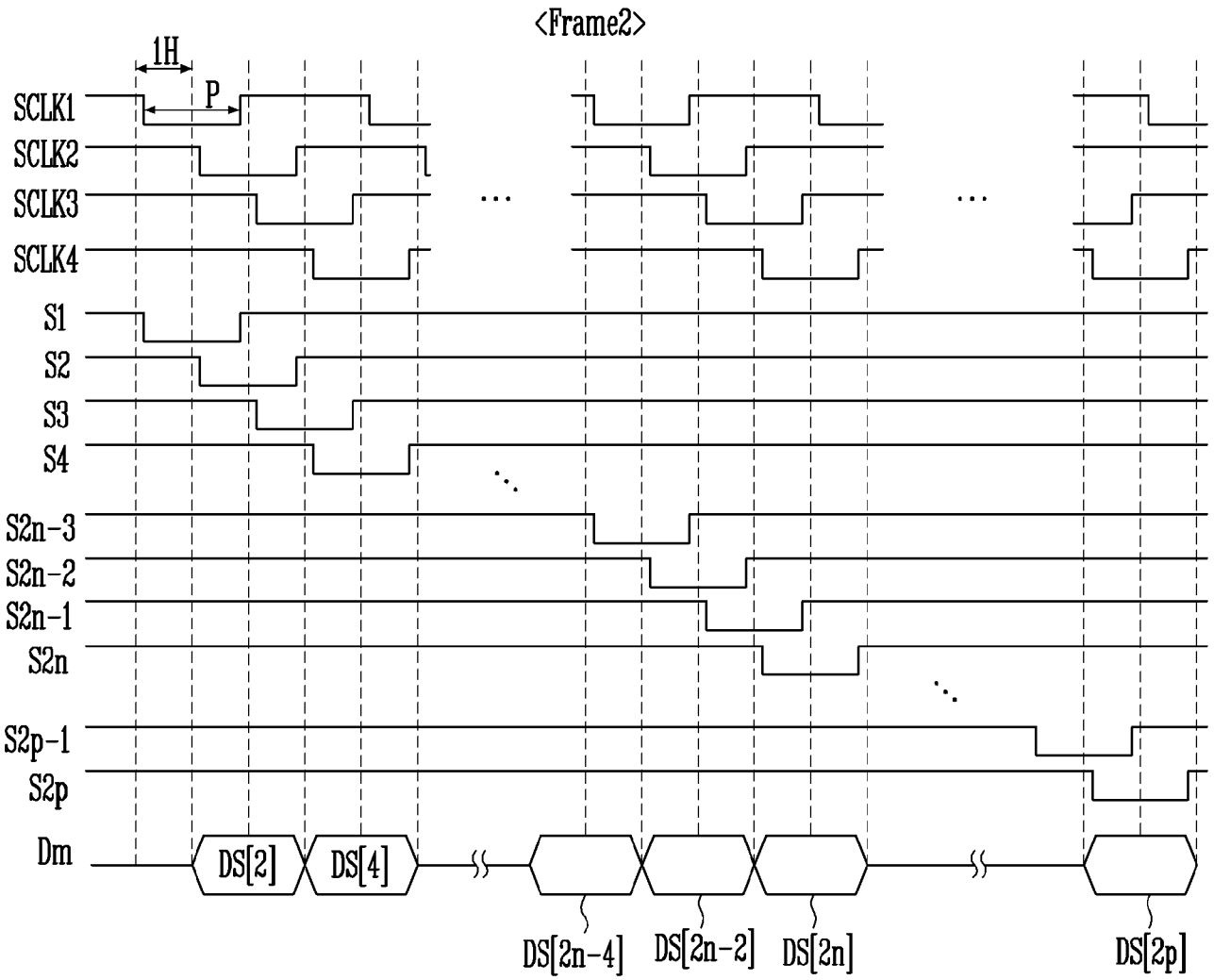
FIG. 5B is a diagram illustrating an example of signals measured in the scan driver and the data driver included in the display device of FIG. 1 in the second frame section.
Figure 6:
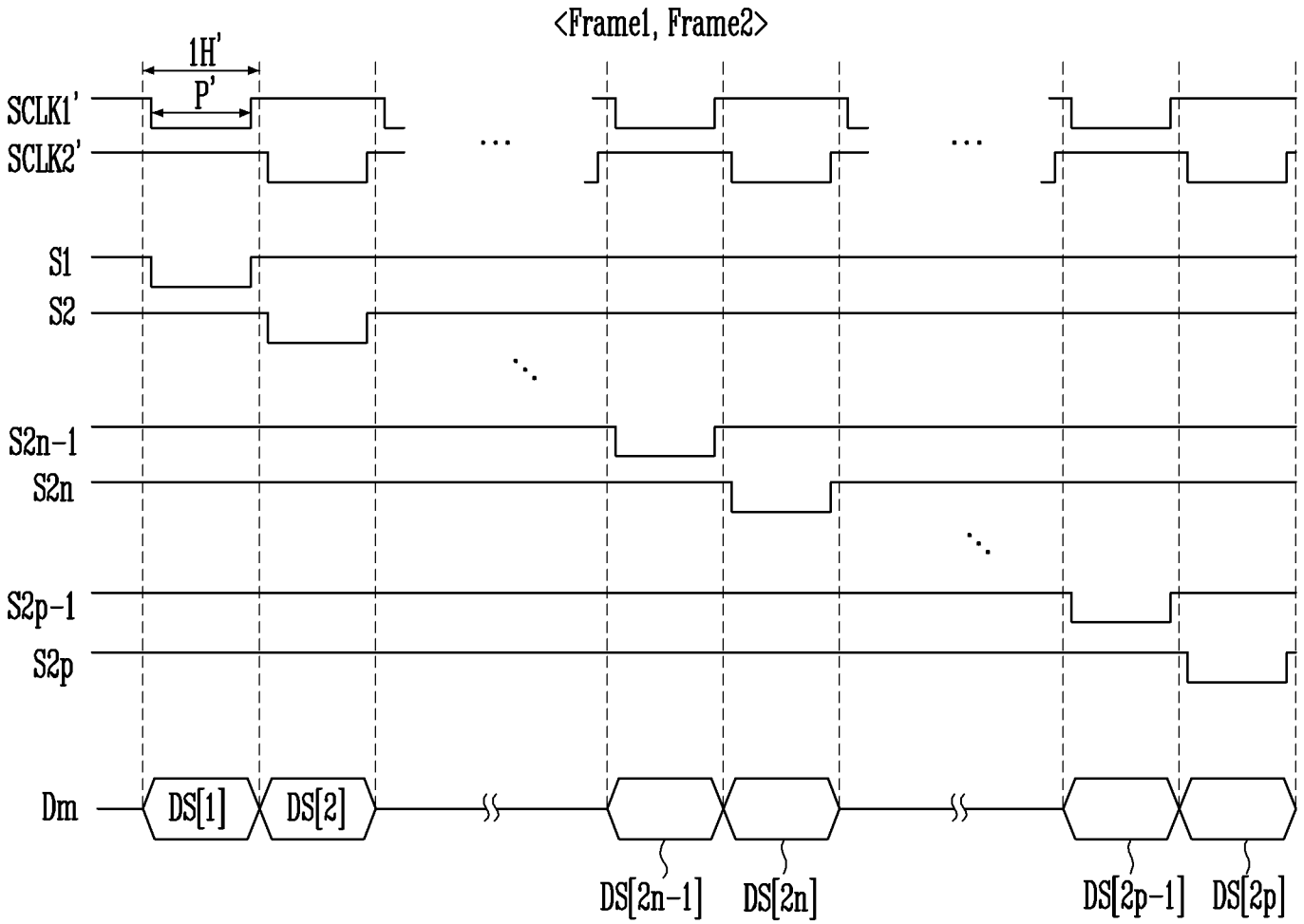
FIG. 6 is a diagram illustrating a comparative example of signals measured in the scan driver and the data driver included in the display device of FIG. 1 in the first and second frame sections.

FIG. 5A is a diagram illustrating an example of signals measured in a scan driver and a data driver included in the display device of FIG. 1 in the first frame section. FIG. 5B is a diagram illustrating an example of signals measured in the scan driver and the data driver included in the display device of FIG. 1 in the second frame section. FIG. 6 is a diagram illustrating a comparative example of signals measured in the scan driver and the data driver included in the display device of FIG. 1 in the first and second frame sections.

Referring to FIGS. 1 and 5A, in the first frame section Frame1, the timing controller 120 may generate first to fourth scan clock signals SCLK1, SCLK2, SCLK3, and SCLK4.

The first to fourth scan clock signals SCLK1, SCLK2, SCLK3, and SCLK4 may have the same period P, and may be shifted by the first section 1H and sequentially generated. Here, the length of the shifted first section 1H may be substantially the same as the length of the first section 1H described with reference to FIGS. 4A and 4B.

The second scan clock signal SCLK2 may be generated by being shifted by the first section 1H from the first scan clock signal SCLK1, the third scan clock signal SCLK3 may be generated by being shifted by the first section 1H from the second scan clock signal SCLK2, and the fourth scan clock signal SCLK4 may be generated by being shifted by the first section 1H from the third scan clock signal SCLK3.

The scan driver 130 may generate the scan signals to be provided to the scan lines S1, S2, S3, S4, . . . , S2*n*−3, S2*n*−2, S2*n*−1, S2*n*, . . . , S2*p*−1, and S2*p* based on the scan start signal and the first to fourth scan clock signals SCLK1, SCLK2, SCLK3, and SCLK4.

In an exemplary embodiment, the scan signals may be generated in synchronization with the first to fourth scan clock signals SCLK1, SCLK2, SCLK3, and SCLK4, and may be shifted by the first section 1H and sequentially generated.

In an exemplary embodiment, the scan signals may overlap in some sections. For example, a scan signal provided to a second scan line S2 may be generated by being shifted by the first section 1H than a scan signal provided to a first scan line S1, and may be overlapped with each other in some sections.

In the first frame section Frame1, the data driver 160 may provide only the data signals corresponding to grayscale values of the pixels positioned on the odd-numbered horizontal lines to the data lines D. In addition, in the first frame section Frame1, the data driver 160 may provide the data signals to the data lines D in response to a section in which the scan signals are provided to odd-numbered scan lines S1, S3, S2*n*−3, and S2*n*−1.

For example, in the first frame section Frame1, the data driver 160 may continuously provide data signals DS[1], DS[3], DS[5], DS[2*n*−3], DS[2*n*−1], DS[2*n*+1], and DS[2*p*−1] corresponding to the grayscale values of the pixels (for example, the first pixels PX1) positioned on the odd-numbered horizontal lines to the m-th data line Dm so as to correspond to sections in which the scan signals are provided to the odd-numbered scan lines S1, S3, . . . , S2*n*−3, S2*n*−1, . . . , and S2*p*−1.

Referring to FIGS. 5A and 5B, the first to fourth scan clock signals SCLK1, SCLK2, SCLK3, and SCLK4 and the scan signals generated in the second frame section Frame2 are substantially the same as the first to fourth scan clock signals SCLK1, SCLK2, SCLK3, and SCLK4 and the scan signals generated in the first frame section Frame1 described with reference to FIG. 5A. Therefore, duplicate descriptions will not be repeated.

Referring to FIGS. 1 and 5B, in the second frame section Frame2, the data driver 160 may provide only the data signals corresponding to grayscale values of the pixels positioned on the even-numbered horizontal lines to the data lines D. In addition, in the second frame section Frame2, the data driver 160 may provide the data signals to the data lines D in response to a section in which the scan signals are provided to even-numbered scan lines S2, S4, S2*n*−2, S2*n*, . . . , and S2*p*.

For example, in the second frame section Frame2, the data driver 160 may continuously provide data signals DS[2], DS[4], DS[2*n*−4], DS[2*n*−2], DS[2*n*], . . . , and DS[2*p*] corresponding to the grayscale values of the pixels (for example, the second pixels PX2) positioned on the even-numbered horizontal lines to the m-th data line Dm so as to correspond to sections in which the scan signals are provided to the even-numbered scan lines S2, S4, . . . , S2*n*−2, S2*n*, . . . , and S2*p*.

Referring to FIG. 6, in the first and second frame sections Frame1 and Frame2, the timing controller 120 may generate first and second scan clock signals SCLK1' and SCLK2'. The first and second scan clock signals SCLK1' and SCLK2' may have the same period P', and may be shifted by a sixth section 1H' and sequentially generated. Here, according to a driving frequency of the display device, the length of the sixth section 1H' may be the same as or different from the length of the first section 1H described with reference to FIGS. 5A and 5B. The driving frequency may be substantially the frequency at which the data signal is written to the driving transistor of the pixel. For example, the driving frequency may be referred to as a refresh rate or a screen refresh rate, and may indicate the frequency with which a display screen is reproduced for one second.

For example, when the display device 100 (refer to FIG. 1) is driven at a driving frequency of 120 Hz according to a first mode, the first section 1H of FIG. 5A and the sixth section 1H' of FIG. 6 may have a length corresponding to 2.8 μs. In addition, when the display device 100 (refer to FIG. 1) is driven at a driving frequency of 60 Hz according to a second mode, the first section 1H of FIG. 5A and the sixth section 1H' of FIG. 6 may have a length corresponding to 5.5 μs.

In this case, according to the comparative example of FIG. 6, when the display device 100 (refer to FIG. 1) is driven at 120 Hz according to the first mode, the display device 100 (refer to FIG. 1) may be driven according to a high-speed driving method suitable for the high resolution large-size display panel 110 (refer to FIG. 1). However, since the length of the sixth section 1H' is not sufficiently secured (for example, 2.8 μs), the length of the section to which the scan signal is supplied and/or the section to which the data signal is written is not sufficiently secured (for example, 1.69 μs). Thus, deterioration of image quality may occur.

In addition, when the display device 100 (refer to FIG. 1) is driven at 60 Hz according to the second mode, the length of the sixth section 1H' is sufficiently secured (for example, 5.5 μs), so that the length of the section to which the scan signal is supplied and/or the section to which the data signal is written can be sufficiently secured (for example, 4.18 μs). However, according to the driving method of the second mode, as the display device 100 (see FIG. 1) is driven at a low driving frequency, the driving method of the second mode may not be suitable for the high resolution large-size display panel 110 (refer to FIG. 1).

In this case, as described with reference to FIGS. 3, 4A, 4B, 5A and 5B, in a driving method in which the pixels connected to the even-numbered emission control lines E2, E4, E2*n*, . . . , and E2*p* are maintained in the non-light emitting state in the first frame section Frame1 and the pixels connected to the odd-numbered emission control lines E1, E3, E2*n*−1, . . . , and E2*p*−1 are maintained in the non-light emitting state in the second frame section Frame2, although the display device 100 (see FIG. 1) is driven at 120 Hz according to the first mode, the data driver 160 (see FIG. 1) may supply only data signals corresponding to the pixels positioned on the odd-numbered horizontal lines in the first frame section Frame1, and supply only data signals corresponding to the pixels positioned on the even-numbered horizontal lines in the second frame section Frame2. Therefore, the length of the section in which the data signal is written can be sufficiently secured. Accordingly, the display device 100 (refer to FIG. 1) may be driven according to the high-speed driving method suitable for the high resolution large-size display panel 110 (refer to FIG. 1), and the length of the section in which the scan signal is supplied and/or the section in which the data signal is written can also be sufficiently secured.

Figure 7A:
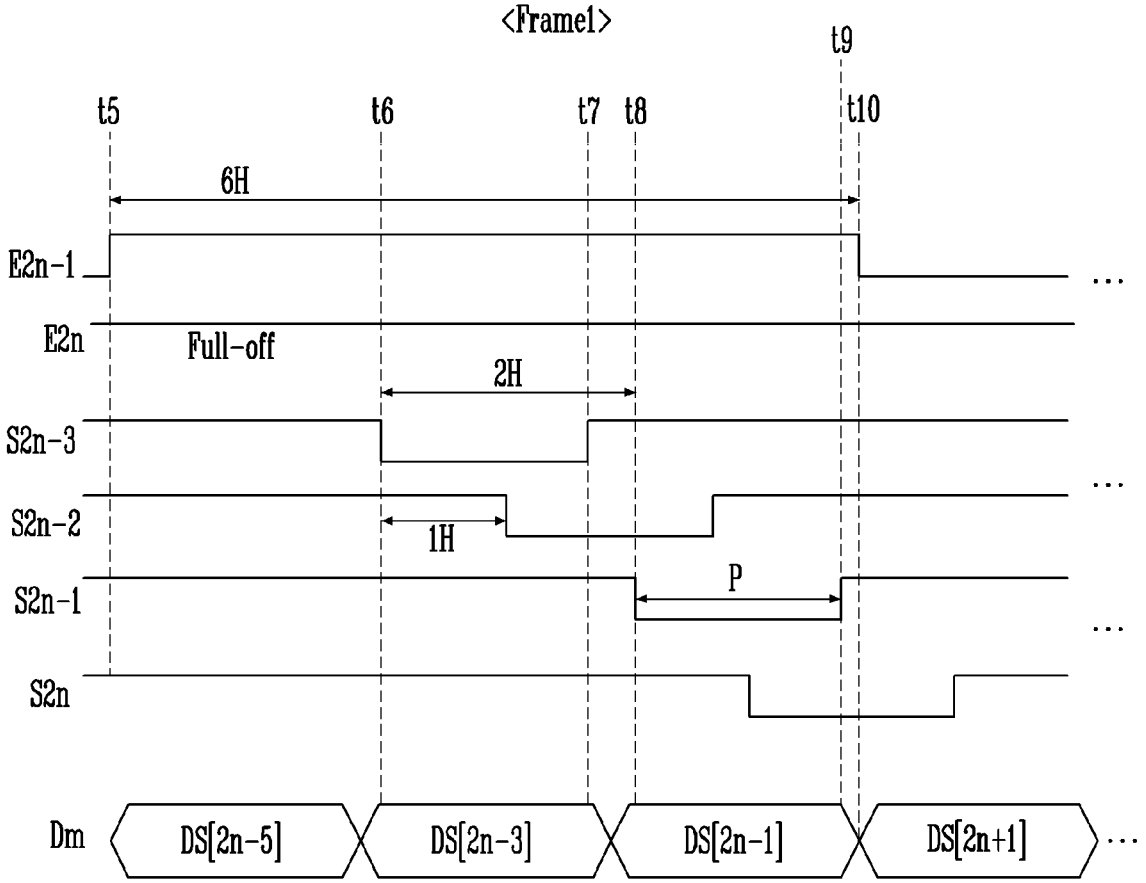
FIGS. 7A and 7B are waveform diagrams for explaining a driving method of the first pixel and the second pixel of FIG. 2.
Figure 7B:
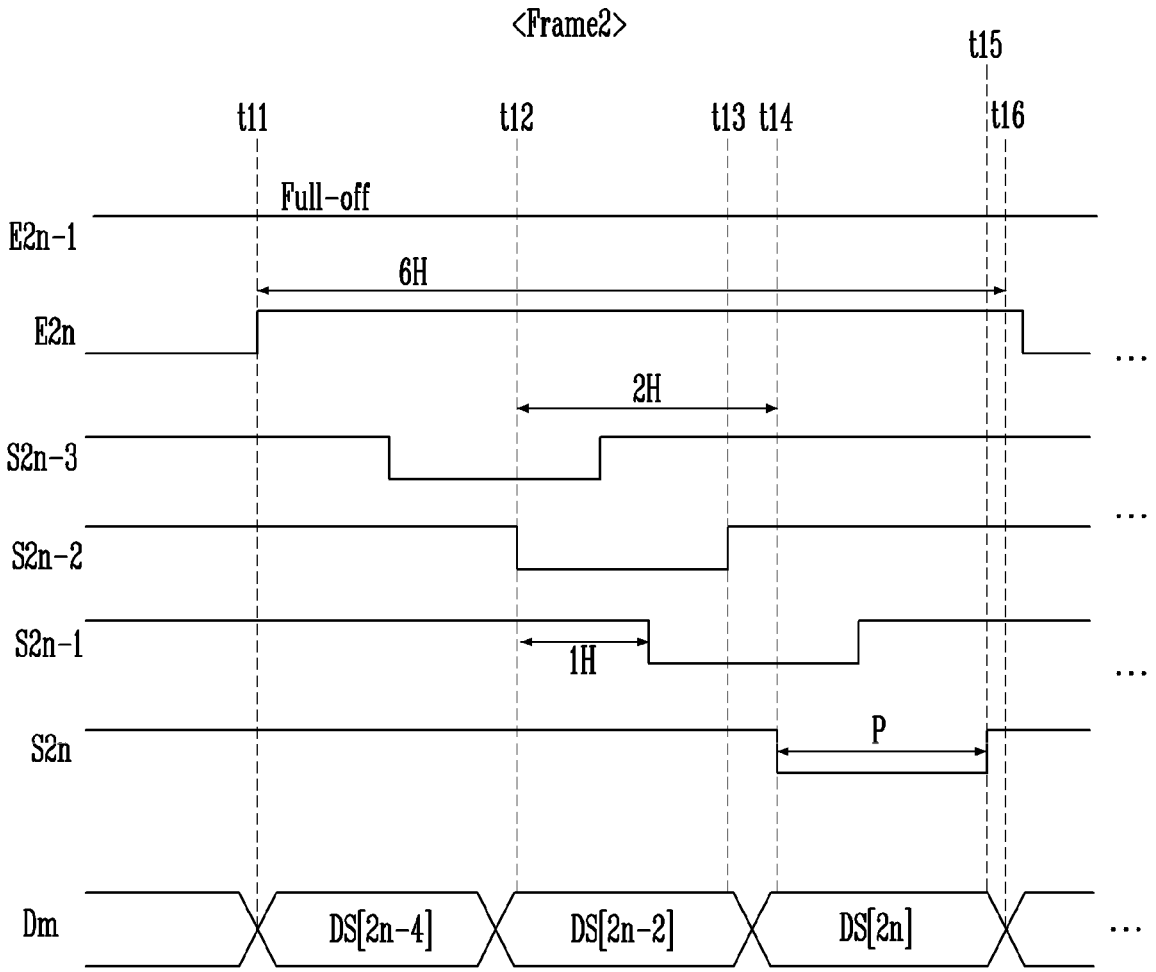

FIGS. 7A and 7B are waveform diagrams for explaining a driving method of the first pixel and the second pixel of FIG. 2.

Referring to FIGS. 4A, 5A and 7A, FIG. 7A illustrates the first and second emission control signals E2*n*−1 and E2*n*, the scan signals S2*n*−3, S2*n*−2, S2*n*−1, and S2*n*, and the data signals DS[2*n*−5], DS[2*n*−3], DS[2*n*−1], and DS[2*n*+1] in the first frame section Frame1 described with reference to FIGS. 4A and 5A.

Similarly, referring to FIGS. 4B, 5B and 7B, FIG. 7B illustrates the first and second emission control signals E2*n*−1 and E2*n*, the scan signals S2*n*−3, S2*n*−2, S2*n*−1, and S2*n*, and the data signals DS[2*n*−4], DS[2*n*−2], and DS[2*n*] in the second frame section Frame2 described with reference to FIGS. 4B and 5B.

First, referring to FIGS. 2 and 7A, at a fifth time point t5, the first emission control signal provided to the (2n−1)th emission control line E2*n*−1 may be changed from the turn-on level to the turn-off level. Accordingly, the fifth and sixth transistors TR5 and TR6 of the first pixel PX1 may be turned off. In this case, the current flowing from the first power source VDD to the second power source VSS may be controlled to prevent light emission of the light emitting element LD.

At a sixth time point t6, the scan signal provided to the (2n−3)th scan line S2*n*−3 may be changed from a turn-off level to the turn-on level. Accordingly, the fourth transistor TR4 of the first pixel PX1 may be turned on. In this case, the initialization power source Vint may be applied to the gate electrode (that is, the third node N3) of the first transistor TR1 of the first pixel PX1 to initialize the gate electrode of the first transistor TR1.

At a seventh time point t7, the scan signal provided to the (2n−3)th scan line S2*n*−3 may be changed from the turn-on level to the turn-off level. Accordingly, the fourth transistor TR4 of the first pixel PX1 may be turned off.

At an eighth time point t8, the scan signal provided to the (2n−1)th scan line S2*n*−1 may be changed from the turn-off level to the turn-on level. Accordingly, the second transistor TR2 of the first pixel PX1 may be turned on to transmit the data signal DS[2*n*−1] provided through the m-th data line Dm to the second node N2.

The third transistor TR3 of the first pixel PX1 may be turned on according to the scan signal of the turn-on level provided to the (2n−1)th scan line S2*n*−1. The turned-on third transistor TR3 may connect the first transistor TR1 in the form of the diode.

In addition, the seventh transistor TR7 of the first pixel PX1 may be turned on according to the scan signal of the turn-on level provided to the (2n−1)th scan line S2*n*−1. The turned-on seventh transistor TR7 may transfer the initialization power source Vint to the anode of the light emitting element LD to initialize the light emitting element LD.

At a ninth time point t9, the scan signal provided to the (2n−1)th scan line S2*n*−1 may be changed from the turn-on level to the turn-off level. Accordingly, the second, third, and seventh transistors TR2, TR3, and TR7 of the first pixel PX1 may be turned off.

At a tenth time point t10, the first emission control signal provided to the (2n−1)th emission control line E2*n*−1 may be changed from the turn-off level to the turn-on level.

Accordingly, the fifth and sixth transistors TR5 and TR6 of the first pixel PX1 may be turned on. A driving current may be formed between the first power source VDD and the second power source VSS so that the light emitting element LD of the first pixel PX1 may emit light with a grayscale corresponding to the data signal DS[2*n*−1].

In the first frame section Frame1, the second emission control signal provided to the 2n-th emission control line E2*n* may be a signal (or a fourth emission control signal) maintained at the turn-off level. Therefore, the fifth and sixth transistors TR5 and TR6 of the second pixel PX2 may maintain a turn-off state. Accordingly, the second pixel PX2 may maintain the non-light emitting state in the first frame section Frame1.

Next, referring to FIGS. 2 and 7B, in the second frame section Frame2, the first emission control signal provided to the (2n−1)th emission control line E2*n*−1 may be a signal (or a third emission control signal) maintained at the turn-off level. Therefore, the fifth and sixth transistors TR5 and TR6 of the first pixel PX1 may maintain the turn-off state. Accordingly, the first pixel PX1 may maintain the non-light emitting state in the second frame section Frame2.

In the second frame section Frame2, the second pixel PX2 may receive the second emission control signal and the scan signal through the 2n-th emission control line E2*n*, the (2n−2)nd scan line S2*n*−2, and the 2n-th scan line S2*n*. Since the remaining operations except for the above operations are substantially the same as the operations of the first pixel PX1 in the first frame section Frame1, duplicate descriptions will not be repeated.

Accordingly, the first pixel PX1 may emit light with the grayscale corresponding to the data signal DS[2*n*−1] provided through the m-th data line Dm based on the first emission control signal provided to the (2n−1)th emission control line E2*n*−1 and the scan signals provided to the (2n−3)th and (2n−1)th scan lines S2*n*−3 and S2*n*−1 in the first frame section Frame1. In addition, the first pixel PX1 does not emit light based on the first emission control signal (or the third emission control signal) provided to the (2n−1)th emission control line E2*n*−1 and maintained at the turn-off level in the second frame section Frame2. Similarly, the second pixel PX2 does not emit light based on the second emission control signal (or the fourth emission control signal) provided to the 2n-th emission control line E2*n* and maintained at the turn-off level in the first frame section Frame1. In addition, the second pixel PX2 may emit light with the grayscale corresponding to the data signal DS[2*n*] provided through the m-th data line Dm based on the second emission control signal provided to the 2n-th emission control line E2*n* and the scan signals provided to the (2n−2)th and 2n-th scan lines S2*n*−2 and S2*n* in the second frame section Frame2.

As described with reference to FIGS. 2, 7A and 7B, the display device 100 (see FIG. 1) including the first and second emission drivers 140 and 150 may independently drive the pixels (for example, the first pixels PX1) positioned on the odd-numbered horizontal lines and the pixels (for example, the second pixels PX2) positioned on the even-numbered horizontal lines in the first frame section Frame1 or the second frame section Frame2. Accordingly, even when the display device 100 (refer to FIG. 1) is driven according to the high-speed driving method, the length of the section in which the scan signal is supplied and/or the section in which is the data signal is written can be sufficiently secured.

Figure 8:
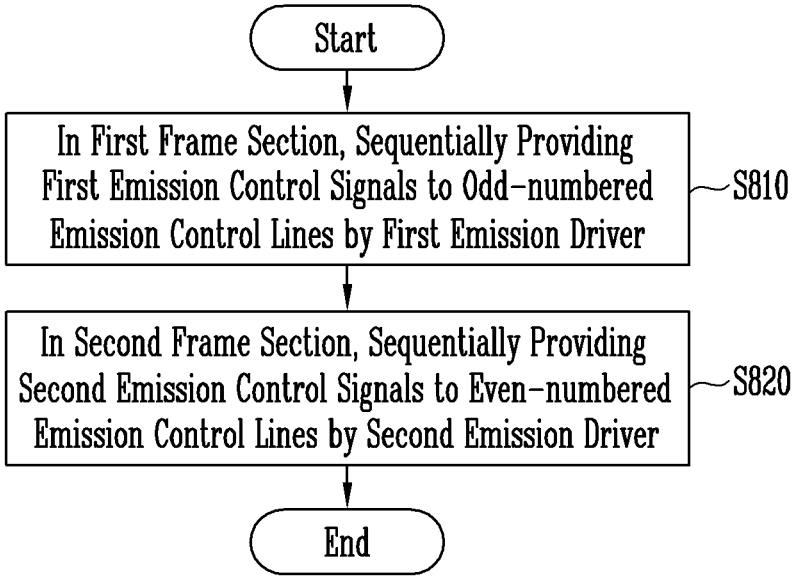
FIG. 8 is a flowchart illustrating a method of driving a display device according to an exemplary embodiment of the present invention.

FIG. 8 is a flowchart illustrating a method of driving a display device according to an exemplary embodiment of the present invention.

Referring to FIGS. 1 and 8, a driving method of a display device of FIG. 8 may be performed by the display device 100 of FIG. 1.

The driving method of FIG. 8 may drive the display device 100 including the display panel 110 including the scan lines S, the emission control lines E, and the pixels PX1 and PX2 connected to the scan lines S and the emission control lines E, the emission drivers 140 and 150, and the scan driver 130. Here, the display device 100 may be substantially the same as the display device 100 of FIG. 1.

According to the driving method of FIG. 8, in a first frame section (for example, an odd-numbered frame section or an even-numbered frame section), first emission control signals may be sequentially provided to odd-numbered emission control lines through a first emission driver (for example, the first emission driver 140 of FIG. 1) (S810).

Thereafter, according to the driving method of FIG. 8, in a second frame section (for example, the even-numbered frame section or the odd-numbered frame section) that is continuous from the first frame section, second emission control signals may be sequentially provided to even-numbered emission control lines through a second emission driver (for example, the second emission driver 150 of FIG. 1) (S820).

Here, a scan driver (for example, the scan driver 130 of FIG. 1) may sequentially provide scan signals to the scan lines in each of the first and second frame sections.

Figure 9A:
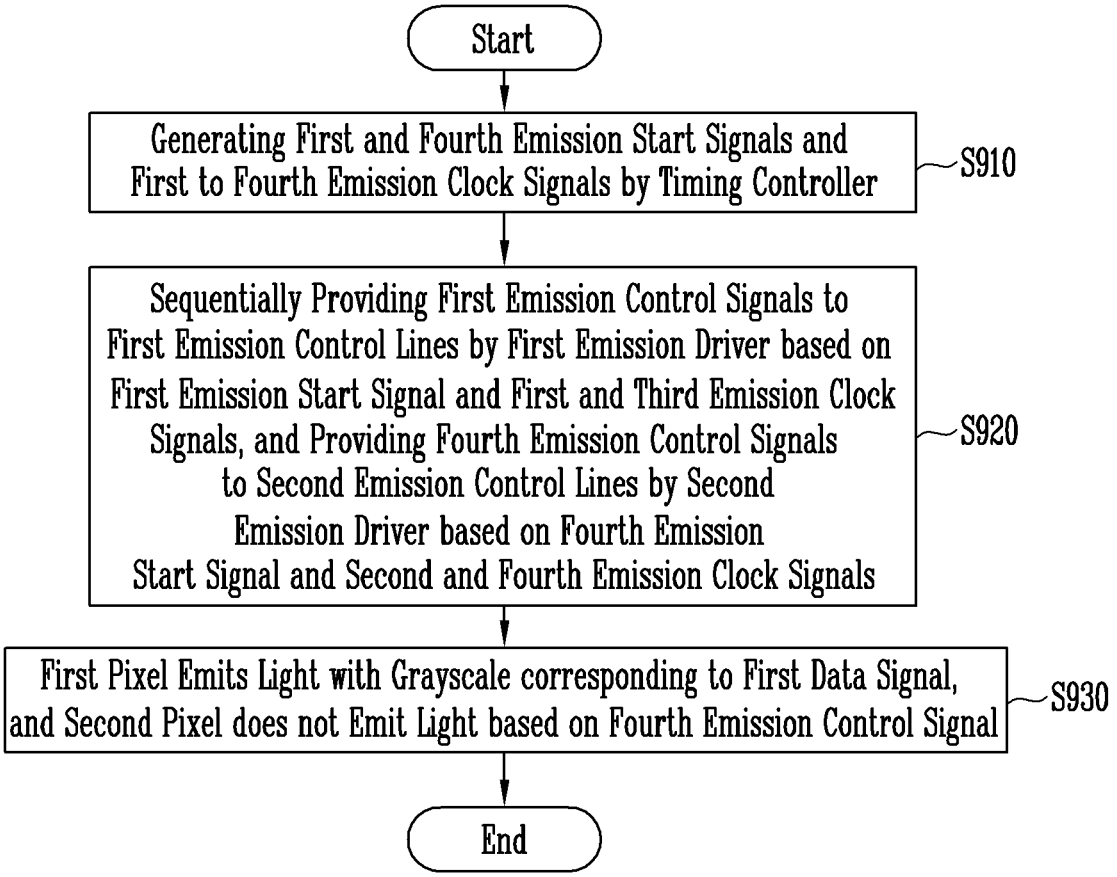
FIG. 9A is a flowchart illustrating a method of driving a display device according to an exemplary embodiment of the present invention in a first frame section.
Figure 9B:
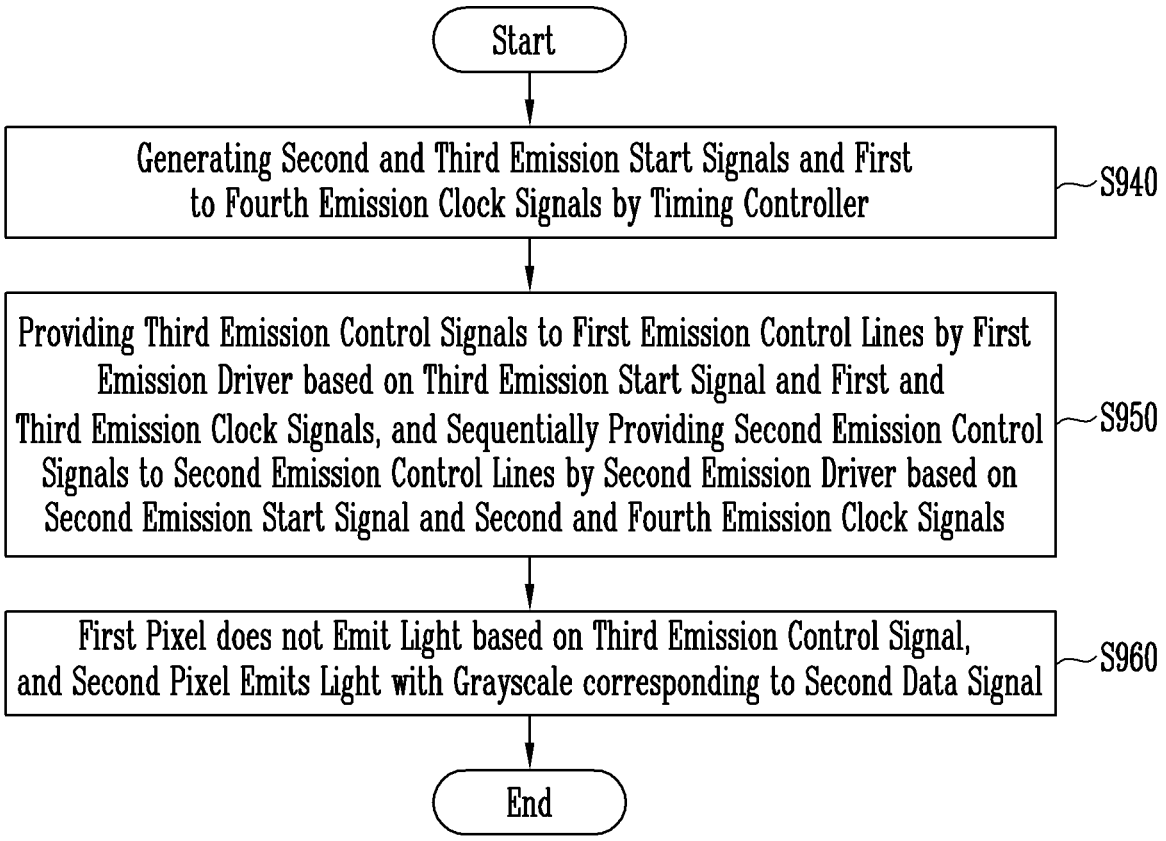
FIG. 9B is a flowchart illustrating a method of driving a display device according to an exemplary embodiment of the present invention in a second frame section.

FIG. 9A is a flowchart illustrating a method of driving a display device according to an exemplary embodiment of the present invention in a first frame section. FIG. 9B is a flowchart illustrating a method of driving a display device according to an exemplary embodiment of the present invention in a second frame section.

Referring to FIGS. 1, 9A and 9B, driving methods of a display device of FIGS. 9A and 9B may be performed by the display device 100 of FIG. 1.

First, according to the driving method of FIG. 9A, first and fourth emission start signals and first to fourth emission clock signals may be generated by a timing controller in a first frame section (S910). Here, the configuration of the timing controller to generate the first and fourth emission start signals and the first to fourth emission clock signals may be the same as the configuration of the timing controller 120 to generate the first emission start signal FLM1 having the turn-off level pulse, the second emission start signal FLM2 (or the fourth emission start signal) maintained at the turn-off level during the first frame section Frame1, and the first to fourth emission clock signals ECLK1, ECLK2, ECLK3, and ECLK4 described with reference to FIGS. 1, 3, 4A and 4B.

Thereafter, according to the driving method of FIG. 9A, in the first frame section, the first emission control signals may be sequentially provided to the first emission control lines through the first emission driver based on the first emission start signal and the first and third emission clock signals, and the fourth emission control signals may be provided to the second emission control lines through the second emission driver based on the fourth emission start signal and the second and fourth emission clock signals (S920). Here, the operations of the first emission driver and the second emission driver in the first frame section may be substantially the same as those of the first emission driver 140 and the second emission driver 150 described with reference to FIGS. 1, 3, 4A and 4B.

Thereafter, according to the driving method of FIG. 9A, in the first frame section, the first pixel may be controlled to emit light with a grayscale corresponding to a first data signal, and the second pixel may be controlled to not emit light based on the fourth emission control signal (S930). Here, the configuration in which the first pixel emits light and the second pixel does not emit light in the first frame section may be substantially the same as the configuration in which first pixel PX1 emits light and the second pixel PX2 does not emit light in the first frame section Frame1 described with reference to FIGS. 2 and 7A.

Next, according to the driving method of FIG. 9B, in the second frame section, second and third emission start signals and the first to fourth emission clock signals may be generated through the timing controller (S940). Here, the configuration in which the second and third emission start signals and the first to fourth emission clock signals are generated by the timing controller may be substantially the same as the configuration in which the first emission start signal FLM1 (or the third emission start signal) maintained at the turn-off level, the second emission start signal FLM2 having the turn-off level pulse, and the first to fourth emission clock signals ECLK1, ECLK2, ECLK3, and ECLK4 are generated by the timing controller 120 during the second frame section Frame2 described with reference to FIGS. 1, 3, 4A and 4B.

Thereafter, according to the driving method of FIG. 9B, in the second frame section, the third emission control signals may be provided to the first emission control lines through the first emission driver based on the third emission start signal and the first and third emission clock signals, and the second emission control signals may be sequentially provided to the second emission control lines through the second emission driver based on the second emission start signal and the second and fourth emission clock signals (S950). Here, the operations of the first and second emission drivers in the second frame section are substantially the same as those of the first and second emission drivers 140 and 150 described with reference to FIGS. 1, 3, 4A and 4B.

Thereafter, according to the driving method of FIG. 9B, in the second frame section, the first pixel may be controlled to not emit light based on the third emission control signal, and the second pixel may be controlled to emit light with a grayscale corresponding to a second data signal (S960). Here, the configuration in which the first pixel does not emit light and the second pixel emits light in the second frame section may be substantially the same as the configuration in which the first pixel PX1 does not emit light and the second pixel PX2 emits light in the second frame section Frame2 described with reference to FIGS. 2 and 7B.

The display device according to the inventive concepts may independently drive the pixels positioned on the odd-numbered horizontal lines and the pixels positioned on the even-numbered horizontal lines in the first frame section or the second frame section. Accordingly, even when the display device is driven according to the high-speed driving method, the length of the section to which the scan signal is supplied and/or the section to which the data signal is written can be sufficiently secured.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel including scan lines, emission control lines, and pixels connected to the scan lines and the emission control lines;

a first emission driver configured to sequentially provide first emission control signals to odd-numbered emission control lines among the emission control lines in a first frame section;

a second emission driver configured to sequentially provide second emission control signals to even-numbered emission control lines among the emission control lines in a second frame section that is continuous from the first frame section;

a scan driver configured to sequentially provide scan signals to all of the scan lines in each of the first and second frame sections; and a timing controller configured to generate a first start signal in the first frame section, generate a second start signal in the second frame section, and generate first to fourth clock signals in the first and second frame sections, wherein:

the first emission control signals have a turn-off level pulse in the second frame section and the second emission control signals have a turn-off level pulse in the first frame section;

the first start signal has a turn-off level pulse in the first frame section, and the second start signal has a turn-off level pulse in the second frame section;

the first to fourth clock signals have the same period, the second clock signal is shifted by a quarter period from the first clock signal, the third clock signal is shifted by a quarter period from the second clock signal, and the fourth clock signal is shifted by a quarter period from the third clock signal;

the first emission driver generates the first emission control signals based on the first start signal and the first and third clock signals; and the second emission driver generates the second emission control signals based on the second start signal and the second and fourth clock signals.

2. The display device of claim 1, wherein:

the first emission driver provides third emission control signals to the odd-numbered emission control lines in the second frame section; and the second emission driver provides fourth emission control signals to the even-numbered emission control lines in the first frame section.

3. The display device of claim 2, wherein:

the timing controller further generates a third start signal in the second frame section, and further generates a fourth start signal in the first frame section;

the third start signal is maintained at a turn-off level during the second frame section, and the fourth start signal is maintained at a turn-off level during the first frame section;

the first emission driver generates the third emission control signals based on the third start signal and the first and third clock signals; and the second emission driver generates the fourth emission control signals based on the fourth start signal and the second and fourth clock signals.

4. The display device of claim 3, wherein the pixels include:

a first pixel connected to a (2n−1)th emission control line among the emission control lines, and a (2n−3)th scan line and a (2n−1)th scan line among the scan lines, where n is a natural number; and a second pixel connected to a 2n-th emission control line among the emission control lines, and a (2n−2)th scan line and a 2n-th scan line among the scan lines.

5. The display device of claim 4, wherein a scan signal provided to the (2n−1)th scan line and a scan signal provided to the 2n-th scan line overlap in some sections.

6. The display device of claim 5, wherein:

the scan signals are provided to the (2n−3)th scan line and the (2n−1)th scan line within a section in which a first emission control signal is provided to the (2n−1)th emission control line among the first frame section; and the scan signals are provided to the (2n−2)th scan line and the 2n-th scan line within a section in which a second emission control signal is provided to the 2n-th emission control line among the second frame section.

7. The display device of claim 6, further comprising a data driver configured to provide data signals to data lines in each of the first and second frame sections, wherein the first and second pixels are connected to an m-th data line among the data lines, where m is a natural number.

8. The display device of claim 7, wherein the data driver provides a first data signal to the m-th data line in a section in which the scan signal is provided to the (2n−1)th scan line among the first frame section, and provides a second data signal to the m-th data line in a section in which the scan signal is provided to the 2n-th scan line among the second frame section.

9. The display device of claim 8, wherein the first pixel emits light with a grayscale corresponding to the first data signal based on the first emission control signal provided to the (2n−1)th emission control line and the scan signal provided to the (2n−1)th scan line in the first frame section, and does not emit light based on a third emission control signal provided to the (2n−1)th emission control line in the second frame section.

10. The display device of claim 8, wherein the second pixel does not emit light based on a fourth emission control signal provided to the 2n-th emission control line in the first frame section, and emits light with a grayscale corresponding to the second data signal based on the second emission control signal provided to the 2n-th emission control line and the scan signal provided to the 2n-th scan line in the second frame section.

11. A method of driving a display device comprising a first emission driver, a second emission driver, a scan driver, and a display panel including scan lines, emission control lines, and pixels connected to the scan lines and the emission control lines, the method comprising:

sequentially providing first emission control signals to odd-numbered emission control lines by the first emission driver in a first frame section; and sequentially providing second emission control signals to even-numbered emission control lines by the second emission driver in a second frame section that is continuous from the first frame section, wherein:

the scan driver sequentially provides scan signals to all of the scan lines in each of the first and second frame sections;

the first emission control signals have a turn-off level pulse in the second frame section and the second emission control signals have a turn-off level pulse in the first frame section;

the display device further comprises a timing controller;

the method further comprises:

generating a first start signal and first to fourth clock signals by the timing controller in the first frame section; and generating a second start signal and the first to fourth clock signals by the timing controller in the second frame section;

the first start signal has a turn-off level pulse in the first frame section, and the second start signal has a turn-off level pulse in the second frame section;

the first to fourth clock signals have the same period, the second clock signal is shifted by a quarter period from the first clock signal, the third clock signal is shifted by a quarter period from the second clock signal, and the fourth clock signal is shifted by a quarter period from the third clock signal;

the first emission driver generates the first emission control signals based on the first start signal and the first and third clock signals; and the second emission driver generates the second emission control signals based on the second start signal and the second and fourth clock signals.

12. The method of claim 11, wherein:

the timing controller further generates a fourth start signal in the first frame section, and further generates a third start signal in the second frame section;

the method further comprises:

providing fourth emission control signals to the even-numbered emission control lines by the second emission driver based on the fourth start signal and the second and fourth clock signals in the first frame section; and providing third emission control signals to the odd-numbered emission control lines by the first emission driver based on the third start signal and the first and third clock signals in the second frame section; and the third start signal is maintained at a turn-off level during the second frame section, and the fourth start signal is maintained at a turn-off level during the first frame section.

13. The method of claim 12, wherein the pixels include:

a first pixel connected to a (2n−1)th emission control line among the emission control lines, and a (2n−3)th scan line and a (2n−1)th scan line among the scan lines, where n is a natural number; and a second pixel connected to a 2n-th emission control line among the emission control lines, and a (2n−2)th scan line and a 2n-th scan line among the scan lines.

14. The method of claim 13, wherein:

the scan signals are provided to the (2n−3)th scan line and the (2n−1)th scan line within a section in which a first emission control signal is provided to the (2n−1)th emission control line among the first frame section; and the scan signals are provided to the (2n−2)th scan line and the 2n-th scan line within a section in which a second emission control signal is provided to the 2n-th emission control line among the second frame section.

15. The method of claim 14, wherein:

the display device further comprises a data driver providing data signals to data lines;

the first and second pixels are connected to an m-th data line among the data lines, where m is a natural number; and the data driver provides a first data signal to the m-th data line in the first frame section, and provides a second data signal to the m-th data line in the second frame section.

16. The method of claim 15, wherein the first data signal is provided to overlap a section in which a scan signal is provided to the (2n−1)th scan line, and the second data signal is provided to overlap a section in which a scan signal is provided to the 2n-th scan line.

17. The method of claim 16, further comprising:

emitting light of the first pixel at a grayscale corresponding to the first data signal based on the first emission control signal provided to the (2n−1)th emission control line and the scan signal provided to the (2n−1)th scan line in the first frame section; and not emitting light of the second pixel based on a fourth emission control signal provided to the 2n-th emission control line in the first frame section.

18. The method of claim 16, further comprising:

not emitting light of the first pixel based on a third emission control signal provided to the (2n−1)th emission control line in the second frame section; and emitting light of the second pixel at a grayscale corresponding to the second data signal based on the second emission control signal provided to the 2n-th emission control line and the scan signal provided to the 2n-th scan line in the second frame section.

* * * * *